US007269550B2

(12) United States Patent
Tsushima et al.

(10) Patent No.: US 7,269,550 B2
(45) Date of Patent: Sep. 11, 2007

(54) ENCODING DEVICE AND DECODING DEVICE

(75) Inventors: Mineo Tsushima, Katano (JP); Takeshi Norimatsu, Kobe (JP); Naoya Tanaka, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 786 days.

(21) Appl. No.: 10/409,101

(22) Filed: Apr. 9, 2003

(65) Prior Publication Data

US 2003/0195742 A1 Oct. 16, 2003

(30) Foreign Application Priority Data

Apr. 11, 2002 (JP) ..... 2002-108703

(51) Int. Cl.
*G10L 19/14* (2006.01)

(52) U.S. Cl. ..... 704/205; 704/500; 704/501; 704/503; 704/504

(58) Field of Classification Search ..... 704/205, 704/500–504
See application file for complete search history.

(56) References Cited

U.S. PATENT DOCUMENTS 5,109,417 A * 4/1992 Fielder et al. ..... 704/205
5,394,473 A * 2/1995 Davidson ..... 704/200.1
5,654,952 A * 8/1997 Suzuki et al. ..... 369/59.16
5,684,920 A * 11/1997 Iwakami et al. ..... 704/203
5,765,126 A * 6/1998 Tsutsui et al. ..... 704/200.1
6,366,545 B2 * 4/2002 Koyata ..... 369/59.16
6,522,747 B1 * 2/2003 Reilly et al. ..... 379/406.14
6,895,375 B2 * 5/2005 Malah et al. ..... 704/219

FOREIGN PATENT DOCUMENTS

WO 98/57436 12/1998
WO 02/23530 3/2002

* cited by examiner

*Primary Examiner*—Richemond Dorvil
*Assistant Examiner*—Qi Han
(74) *Attorney, Agent, or Firm*—Wenderoth, Lind & Ponack, L.L.P.

(57) ABSTRACT

An encoding device (200) includes: a time characteristic extracting unit (203) that specifies a band for a part of a frequency spectrum based on a characteristic of an audio input signal in a time domain; a time transforming unit (204) that transforms a signal in the specified band to a signal according to frequency-time transform; and an encoded data stream generating unit (205) that encodes the signal obtained by the time transforming unit (204) and at least a part of the frequency spectrum, and generates an output encoded data stream from the encoded signal and the encoded frequency spectrum.

25 Claims, 21 Drawing Sheets

Fig. 1 PRIOR ART

ENCODING DEVICE AND DECODING DEVICE

TECHNICAL FIELD

The present invention relates to encoding methods for compressing data by encoding signals obtained by transforming audio signals such sound and music signals in the time domain into those in the frequency domain with a smaller amount of encoded data stream, using a method such as an orthogonal transform, and decoding methods for expanding the data upon receipt of the encoded data stream and obtaining the audio signals.

BACKGROUND ART

A number of methods of encoding and decoding audio signals have been developed up to now. Particularly, in these days, IS13818-7, which is internationally standardized in ISO/IEC, is publicly known and highly appreciated as an encoding method for reproducing high quality sound with high efficiency. This encoding method is called Advanced Audio Coding (AAC). In recent years, the AAC is adopted to the standardization called MPEG 4, and a system called MPEG-4 AAC that has some extended functions added to the IS13818-7 has been developed. An example of the encoding procedure is described in the informative part of the MPEG-4 AAC.

The following is an explanation for an audio encoding device using the conventional encoding method referring to FIG. 1. FIG. 1 is a block diagram that shows the structure of a conventional encoding device 100. The encoding device 100 includes a time-frequency transforming unit 101, a spectrum amplifying unit 102, a spectrum quantizing unit 103, a Huffman coding unit 104 and an encoded data stream transfer unit 105. A digital audio signal on the time axis obtained by sampling an analog audio signal at a predetermined frequency is divided into every predetermined number of samples at a predetermined time interval, transformed into data on the frequency axis through the time-frequency transforming unit 101, and then given to the spectrum amplifying unit 102 as an input signal into the encoding device 100. The spectrum amplifying unit 102 amplifies a spectrum included in every predetermined band with one certain gain. The spectrum quantizing unit 103 quantizes the amplified spectrum with a predetermined transform expression. In the case of AAC method, the quantization is conducted by rounding off frequency spectral data, which is expressed in floating points into an integer value. The Huffman coding unit 104 encodes the quantized spectral data in a set of certain pieces thereof according to Huffman coding, and encodes the gain in every predetermined band in the spectrum amplifying unit 102 and the data that specifies the transform expression for the quantization according to Huffman coding, and then transmits the codes of them to the encoded data stream transfer unit 105. The Huffman-coded data stream is transferred from the encoded data stream transfer unit 105 to a decoding device via a transmission channel or a recording medium, and reconstructed as an audio signal on the time axis by the decoding device. The conventional encoding device operates as described above.

However, in the conventional encoding device 100, a capability for compressing data amount depends on the performance of the Huffman coding unit 104 or the like, so when the encoding is conducted at a high compression rate, that is, with a small amount of data, it is necessary to increase the gain sufficiently in the spectrum amplifying unit 102 and encode the quantized spectrum stream obtained by the spectrum quantizing unit 103 so as to make it a smaller amount of data in the Huffman coding unit 104. According to this method, if the encoding is carried out for making an amount of data smaller, the frequency bandwidth for reproduced sound and music practically becomes narrow. Therefore, it cannot be denied that the sound and music would be furry for human hearing. As a result, it is impossible to maintain the sound quality. That is a problem.

Also, within the conventional encoding device 100, the input signal expressed on the time axis is transformed into the frequency spectrum expressed on the frequency axis by each predetermined interval (the number of samples) in the time-frequency transforming unit 101. Therefore, the signal quantized for the encoding in this latter stage is the spectrum on the frequency axis. It is inevitable for a quantizing process to have some quantization errors through processing such as rounding off a decimal value in the frequency spectral data into an integer value. On contrary to a fact that assessment of the quantization error generated in the signal is easy on the frequency axis, it is difficult on the time axis. Because of this, it is not easy to improve time resolution ability of the encoding device through the assessment of the quantization error reflected on the time axis. Also, if the amount of data available to allocate to the encoding is sufficient, it is possible to improve both frequency resolution ability and time resolution ability. But if the amount of data allocated for the encoding is small, it is extremely difficult to improve both.

In view of the above-mentioned problem, the present invention aims at providing an encoding device, capable of encoding an audio signal at a high compression rate with an advanced level of the time resolution ability, and a decoding device capable of decoding frequency spectral data in a wide band.

DISCLOSURE OF INVENTION

The encoding device according to the present invention is a encoding device that encodes a signal in a frequency domain obtained by transforming an input original signal according to time-frequency transformation, and generates an output signal comprising: a first band specifying unit operable to specify a band for a part of a frequency spectrum based on a characteristic of the input original signal; a time transforming unit operable to transform a signal in the specified band to a signal according to frequency-time transformation; and an encoding unit operable to encode the signal obtained by the time transforming unit and at least a part of the frequency spectrum, and generate an output signal from the encoded signal and the encoded frequency spectrum.

Also, the decoding device of the present invention is a decoding device that decodes an encoded data stream obtained by encoding an input original signal, and outputs a frequency spectrum, comprising: a decoding unit operable to extract a part of the encoded data stream contained in the input encoded data stream, and decode the extracted encoded data stream; a frequency transforming unit operable to transform a signal obtained by decoding the extracted encoded data stream to a frequency spectrum; and a composing unit operable to compose a frequency spectrum, which is obtained by decoding an encoded data stream extracted from other part of the input encoded data stream, and the frequency spectrum, which is obtained by the frequency transforming unit, on a frequency axis.

As mentioned above, according to the encoding device and the decoding device of the present invention, by adding the encoding in the time domain in addition to the encoding in the time domain, it becomes possible to select the encoding in a domain with a higher encoding efficiency and reduce a bit volume of an encoded data stream that is output. Furthermore, by adding the encoding in the time domain, it becomes easy to improve the time resolution ability as well as the frequency resolution ability.

Also, the encoding device and the decoding device according to the present invention can provide a wide-band encoded audio data stream at a low bit rate. For a component in a lower frequency region, its microstructure of the frequency is encoded by using a compression technique such as the Huffman coding. For a component in a higher frequency region, mainly data, which is reproduced by substituting the spectrum in the lower frequency region for the spectrum in the higher frequency region, is only encoded in stead of encoding its microstructure, so that the amount of data used for the encoding by the component in the high frequency can be minimized.

According to the decoding device of the present invention, since the component in the high frequency region is generated by processing a reproduction of a spectrum in the lower frequency region in a process of the decoding at the time of reproducing the audio signal, it can be achieved by a low bit rate easily and sound can be reproduced in a wider band than the one reproduced by the conventional decoding device at the same rate.

DETAILED DESCRIPTION OF THE INVENTION

The encoding devices and the decoding devices according to the embodiments of the present invention will be explained with reference to figures (FIG. 2~FIG. 20).

First Embodiment

Figure 1:
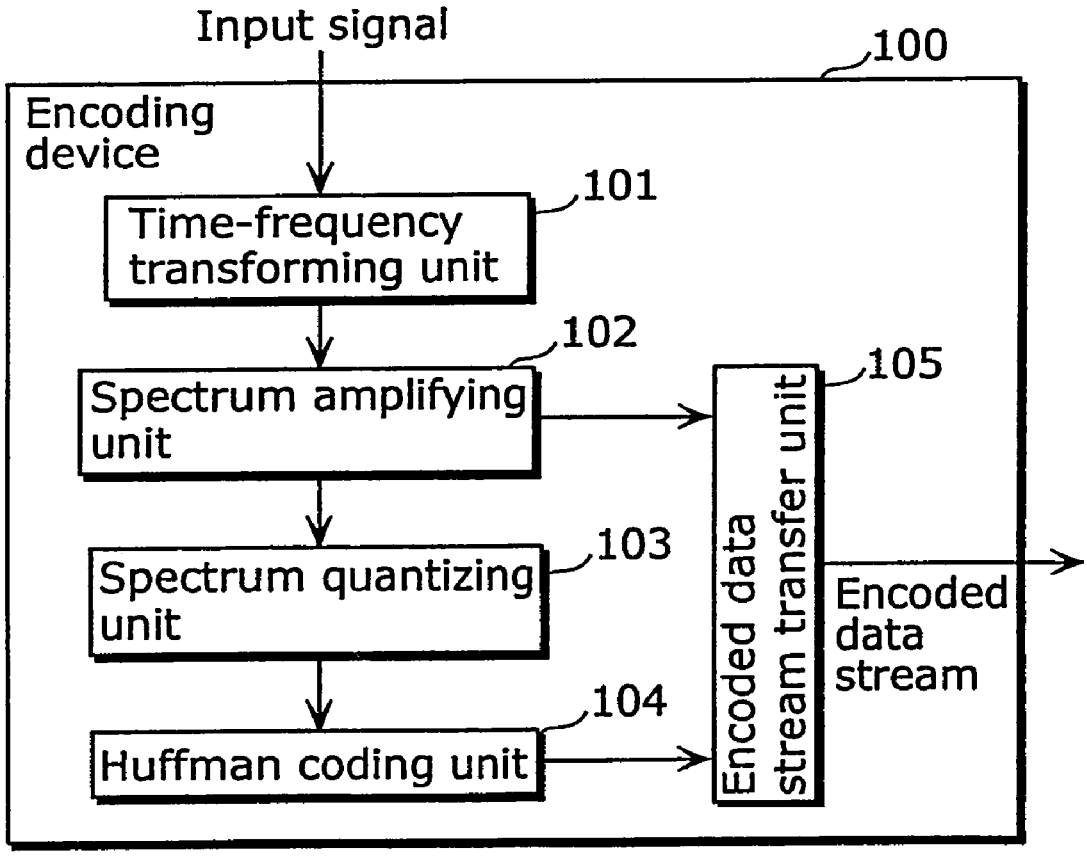
FIG. 1 is a block diagram showing the structure of the conventional encoding device.
Figure 2:
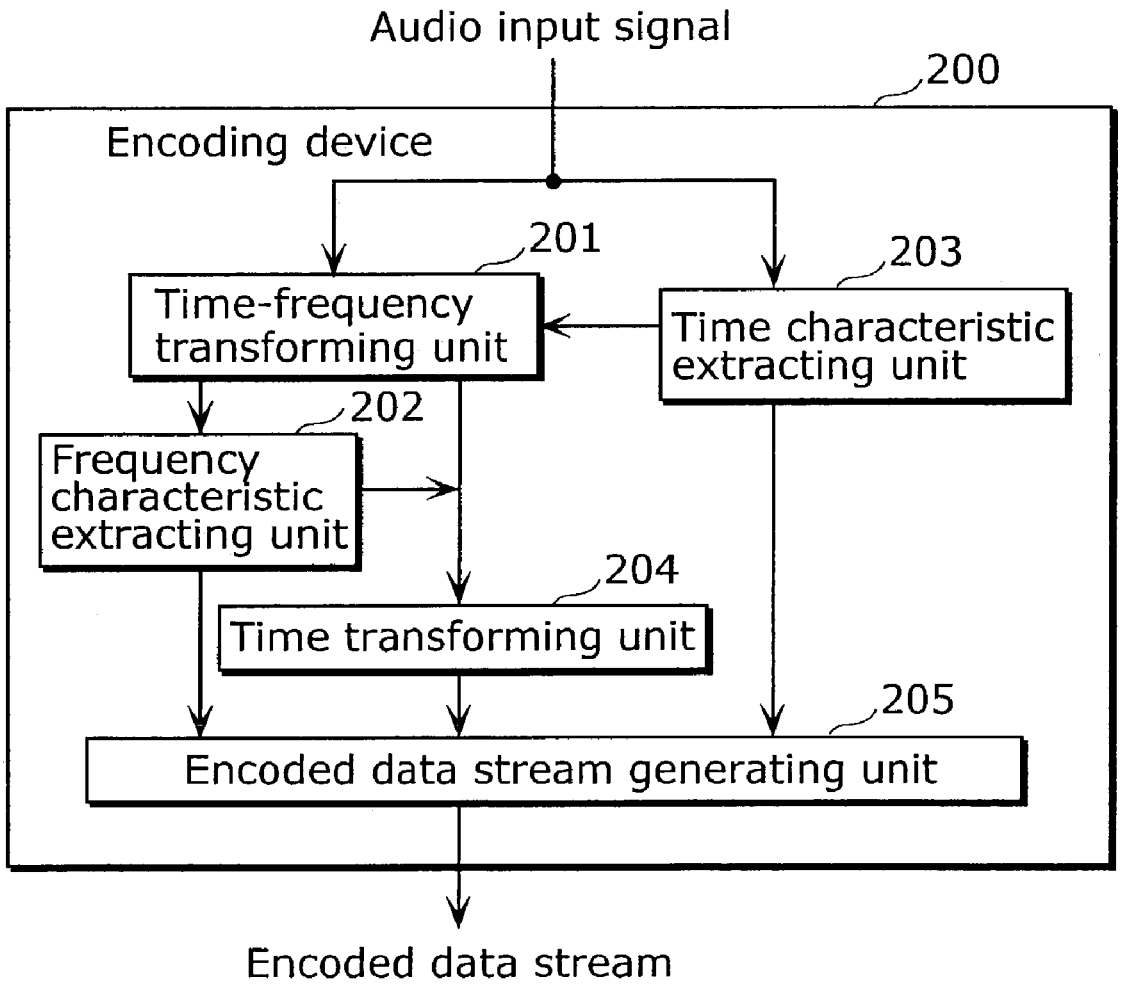
FIG. 2 is a block diagram showing the structure of the decoding device according to a first embodiment of the present invention.

FIG. 2 is a block diagram showing the structure of an encoding device 200 according to the first embodiment of the present invention. The encoding device 200 is an encoding device that extracts a time characteristic of an audio input signal expressed on a time axis and encodes after partially transforming a part of a frequency spectrum into a frequency signal in a time domain based on the extracted time characteristic, which includes a time-frequency transforming unit 201, a frequency characteristic extracting unit 202, a time characteristic extracting unit 203, a time transforming unit 204 and an encoded data stream generating unit 205.

The time-frequency transforming unit 201 transforms the audio input signal from a discrete signal on the time axis to frequency spectral data at regular intervals. To be more specific, the time-frequency transforming unit 201 transforms the audio signal at a time in the time domain based on, for example, one frame (1024 samples) as a unit, and generates a frequency spectral coefficient for the 1024 samples or the like as a result of the transform. The MDCT transform or the like is used as the time-frequency transform, and an MDCT coefficient or the like is generated as a result of the transform. A plural number of the frequency spectral coefficients in a band specified by the time characteristic extracting unit 203 are output from them to the time transforming unit 204, and the frequency spectral coefficients in the band other than that are output to the frequency characteristic extracting unit 202.

The frequency characteristic extracting unit 202 extracts a frequency characteristic of the frequency spectrum, selects a band with a poor encoding efficiency for the case of the quantization and encoding in the frequency domain based on the extracted characteristic, divides it from the frequency spectrum output by the time-frequency transforming unit 201, and outputs it to the time transforming unit 204. The frequency spectrum of the band other than that is input to the encoded data stream generating unit 205.

The time characteristic extracting unit 203 analyzes the time characteristic of the audio input signal, decides whether time resolution ability is prioritized or frequency resolution ability is prioritized when the quantization takes places in the encoded data stream generating unit 205, and specifies a frequency band where the time resolution ability is decided to be prioritized. The time transforming unit 204 transforms the frequency spectrum in the band, where the time resolution ability is decided to be prioritized, and the spectrum in the band selected by the frequency characteristic extracting unit 202 into a time-frequency signal indicated as a temporal change in the frequency spectral coefficient, using a fully reversible transform expression. After consequently quantizing the frequency spectrum input from the time-frequency transforming unit 201 and the time-frequency signal input from the time transforming unit 204, the encoded data stream generating unit 205 encodes them. Moreover, the encoded data stream generating unit 205 attaches additional data such as a header to the encoded data, and generates an encoded data stream according to a predetermined format, and outputs the generated encoded data stream to an outside of the encoding device 200.

Figure 3:
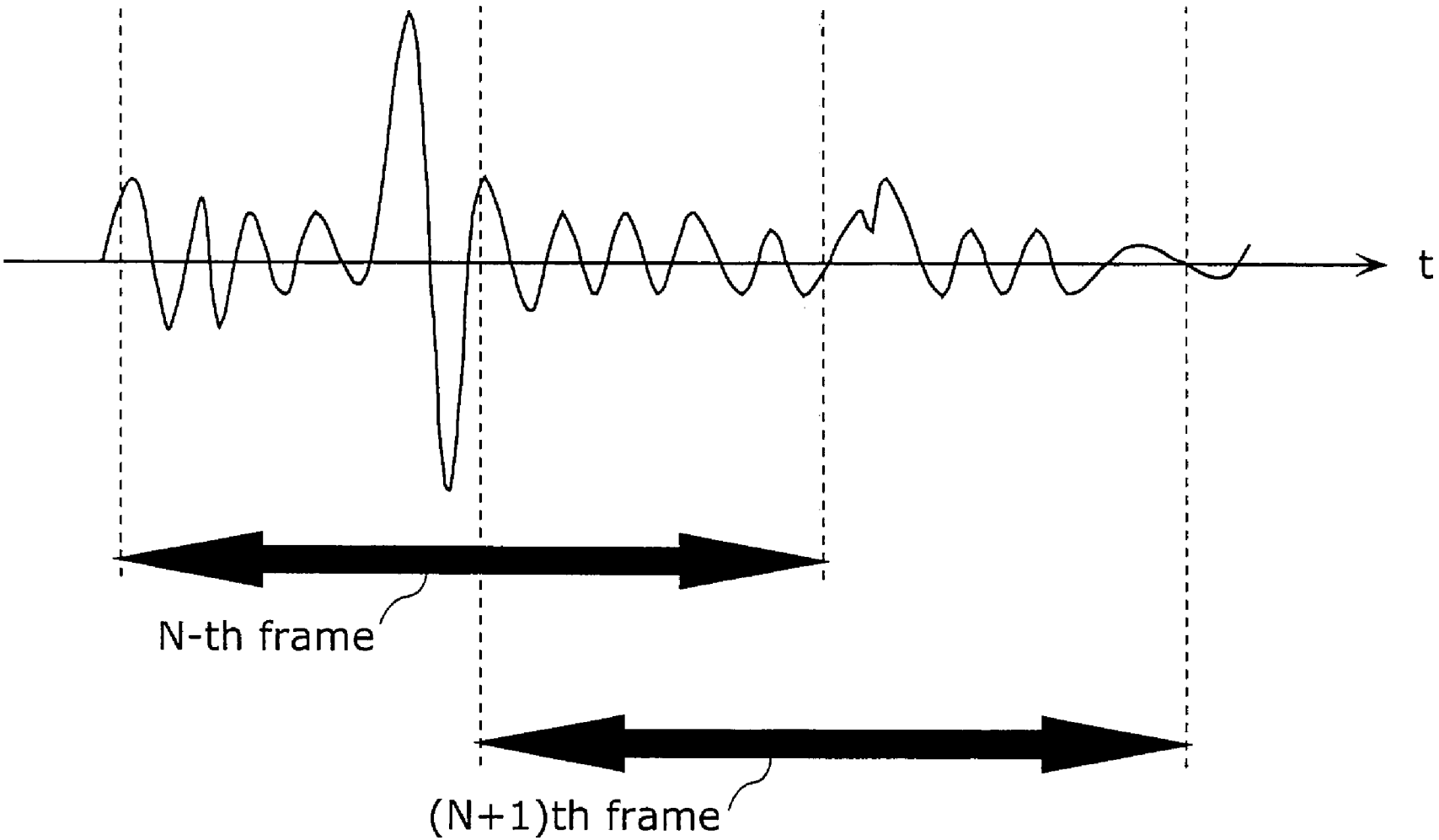
FIG. 3 is a diagram showing an example of time-frequency transform by a time-frequency transforming unit shown in FIG. 2.

FIG. 3 is a diagram showing an example of time-frequency transform by the time-frequency transforming unit 201 shown in FIG. 2. The time-frequency transforming unit 201 divides, for example, as shown in FIG. 3, the discrete signal on the time axis at regular time intervals allowing some overlap, and executes the transform. In contrast with the N-th frame (N is a positive integer), FIG. 3 shows the case for extracting the (N+1)th frame by allowing a half of its frame to be overlapped with the N-th frame, and transforming it. In general, the time-frequency transforming unit 201 transforms data by Modified Discrete Cosine Transform (MDCT). However, a transform method by the time-frequency transforming unit 201 is not limited to the MDCT. It may be a polyphase filter or Fourier transform. Since anyone concerned is familiar with any of the MDCT, the polyphase filter and the Fourier transform, their explanation is omitted here.

Figure 4A:
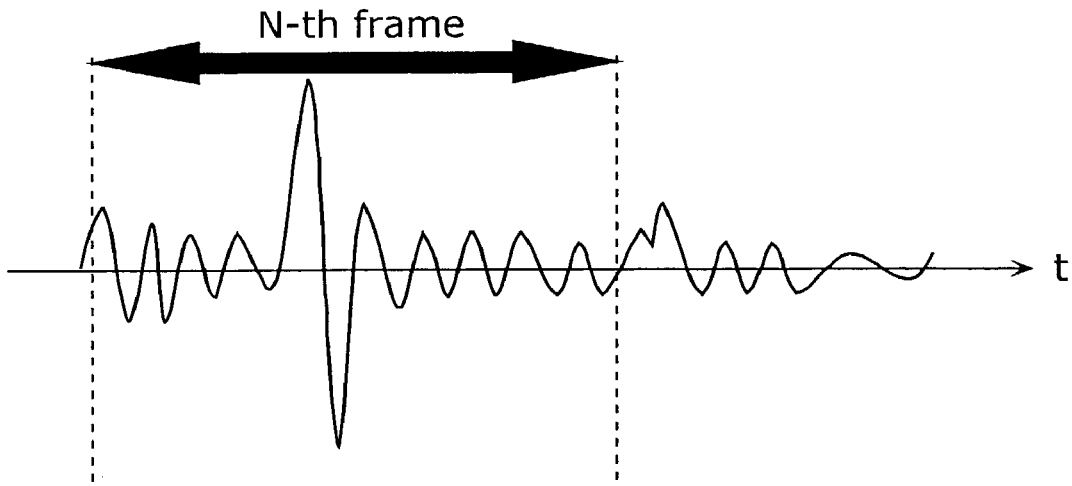
FIG. 4A is a diagram showing an audio signal in the time domain input to the time-frequency transforming unit. A signal in a part equivalent to an N-th frame is supposed to be transformed at a time according to frequency transform in the diagram.
Figure 4B:
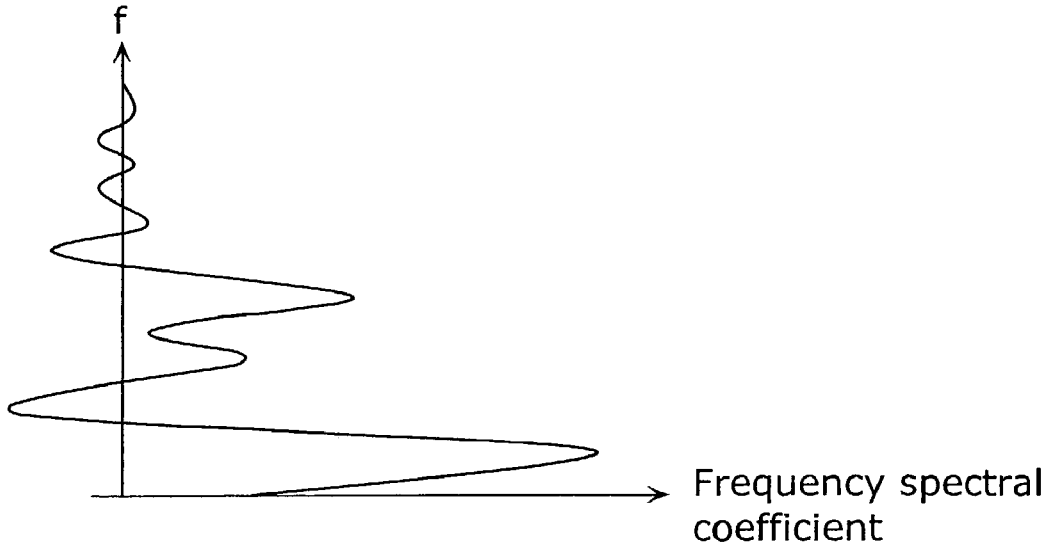
FIG. 4B is a diagram showing a frequency spectrum obtained by execute the time-frequency transform at a time to the audio signal in the N-th frame shown in FIG. 4A.

FIG. 4A is a diagram showing an audio signal in the time domain input to the time-frequency transforming unit 201. Suppose the signal in the part equivalent to the N-th frame is frequency-transformed at a time in the same diagram. FIG. 4B is a diagram showing a frequency spectrum obtained by executing the time-frequency transform at a time to the audio signal in the N-th frame shown in FIG. 4A. This diagram is plotted by using the frequency on a vertical axis and the frequency spectral coefficient value for the frequency on a horizontal axis. As shown here, the signal in the time domain for the N-th frame is transformed to the signal in the frequency domain. The frequency spectrum shown in FIG. 4B indicates a characteristic of a frequency component contained in the audio signal within a frame time duration shown in FIG. 4A. When the MDCT is used for the time-frequency transforming unit 201, the signal in the time domain and the signal in the frequency domain have the same number of effective samples. Regarding the number of the effective samples, in the case of the MDCT, if the number of samples in the N-th frame shown in FIG. 4A is 2048 samples, the number of independent frequency coefficients (MDCT coefficients) shown in FIG. 4B is 1024 samples. However, because the MDCT is an algorithm to overlap the frames by each half of the frames as shown in FIG. 3, the number of the samples newly input in FIG. 4A is 1024 samples. Therefore, the numbers of the samples in FIG. 4A and FIG. 4B are considered to be the same in terms of each amount of data, so that the number of effective samples is regarded to be 1024 based on this. The number of the effective samples in the N-th frame may be 1024 as mentioned above, but it may be 128, or any discretional value. This value is predetermined between the encoding device 200 and a decoding device of the present invention.

On the other hand, the audio input signal is also input to the time characteristic extracting unit 203 besides the time-frequency transforming unit 201. The time characteristic extracting unit 203 analyzes a temporal change of a given audio input signal, and decides whether the time resolution ability should be prioritized or the frequency resolution ability should be prioritized is decided when the audio input signal is quantized. That is to say, the time characteristic extracting unit 203 decides whether the audio input signal should be quantized in the frequency domain or in the time domain. When the quantization takes place in the time domain, the temporal change of the audio input signal is informed to the decoding device by the signal in the time domain. This is further based on the following facts: a) the quantization is accompanied with some quantization errors; and b) though the errors can stay in a specific range of values in the frequency domain when the quantization takes place in the frequency domain, it is difficult to grasp in what range of values the errors are distributed in the time domain. It is due to a reason that high frequency resolution ability can be performed when the quantization is carried out in the frequency domain, whereas high time resolution ability can be performed when the quantization takes place in the time domain. Also, in the case there is a big change in an average energy of the signal that belongs to each of the sub-frames as compared with the average energy of its adjacent sub-frames when a frame of the given audio input signal is divided into a plural number of temporal sub-frames, it assumes that there has been a rapid change in the sound volume of the audio input signal such as an attack. In such a case, it is not preferable that quantization errors spread over the time domain. Because of this, the time characteristic extracting unit 203 decides to give the time resolution ability priority over the frequency resolution ability in the quantization in such band. A threshold value used by the time characteristic extracting unit 203 when deciding the change in the average energy is big (e.g. a threshold value for a difference in the average energy between adjacent sub-frames) is defined according to an implementation method of the encoding device. Then, the time characteristic extracting unit 203 specifies a band for the audio input signal, for which the quantization should be done in the time domain. Selections of the band and the bandwidth are not limited to the above.As to the method to specify the band, at first, a signal containing a sample that gives a maximum amplitude (a peak signal) in the time domain is specified, and a frequency of the peak signal is calculated. Furthermore, the time characteristic extracting unit 203, for example, decides a bandwidth according to size of the peak signal, and specifies a band of the decided bandwidth, including the frequency obtained as a result of the calculation or a frequency close to it. In the time characteristic extracting unit 203, the decision result whether the time resolution ability is prioritized or the frequency resolution ability is prioritized, and the data indicating the specified band are output to the time-frequency transforming unit 201 and the encoded data stream generating unit 205.

The frequency characteristic extracting unit 202 analyzes a characteristic of the frequency spectrum which is an output signal of the time-frequency transforming unit 201, and specifies a band which is better to be quantized in the time domain. For example, considering the encoding efficiency in the encoded data stream generating unit 205, there are many cases that the encoding efficiency is not improved in a band where the adjacent frequency spectral coefficients spread widely in the frequency spectrum, or a band where positive and negative codes of the adjacent frequency spectral coefficients are switched frequently or the like. Therefore, the frequency characteristic extracting unit 202 samples a band applicable to these from the input frequency spectrum, outputs it to the time transforming unit 204, and also outputs a band inapplicable to these to the encoded data stream generating unit 205 as it is. Along with it, the data to specify the band output to the time transforming unit 204 is output to the encoded data stream generating unit 205.

In the encoded data stream generating unit 205, the output signal of the frequency characteristic extracting unit 202 (data to specify a frequency spectrum and a band), the decision result of the time characteristic extracting unit 203 and the data to specify a band, and the output signal of the time transforming unit 204 (a frequency-time signal) are combined, and the encoded data stream is generated.

Figure 5A:
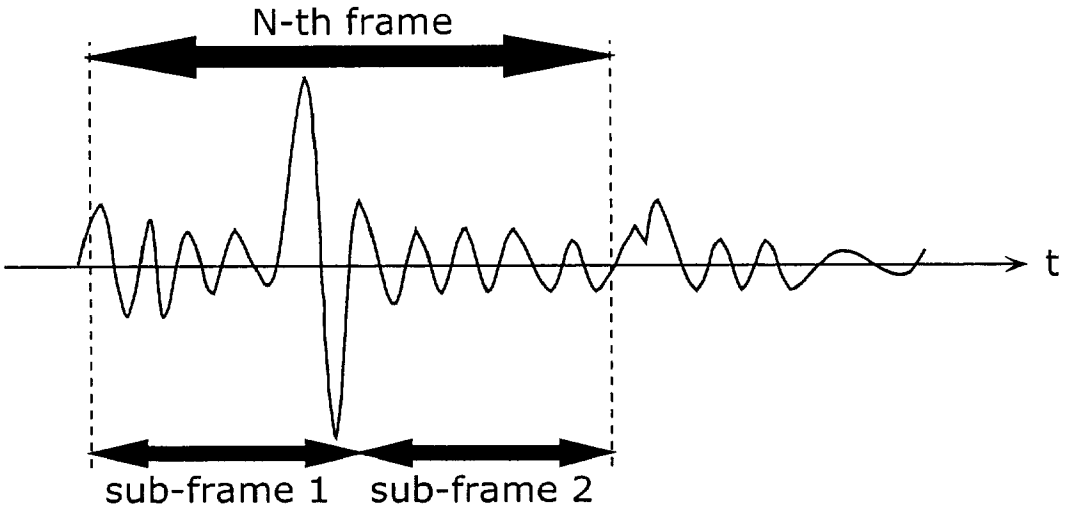
FIG. 5A is a diagram showing how the N-th frame for the audio signal on the same time axis as FIG. 4A is divided into a sub-frame 1 for its first half and a sub-frame 2 for its second half.

FIG. 5A is a diagram showing how an N-th frame is divided into a sub-frame 1 for its first half and a sub-frame 2 for its second half in the audio signal on the same time axis as one of FIG. 4A. Although the diagram shows the case the sub-frame 1 and the sub-frame 2 have the same length, their lengths do not have to be the same or can overlap each other. Hereinafter, just as illustrated in FIG. 5, the case the sub-frame 1 and the sub-frame 2 have the same length is used to simplify the explanation.

Figure 5B:
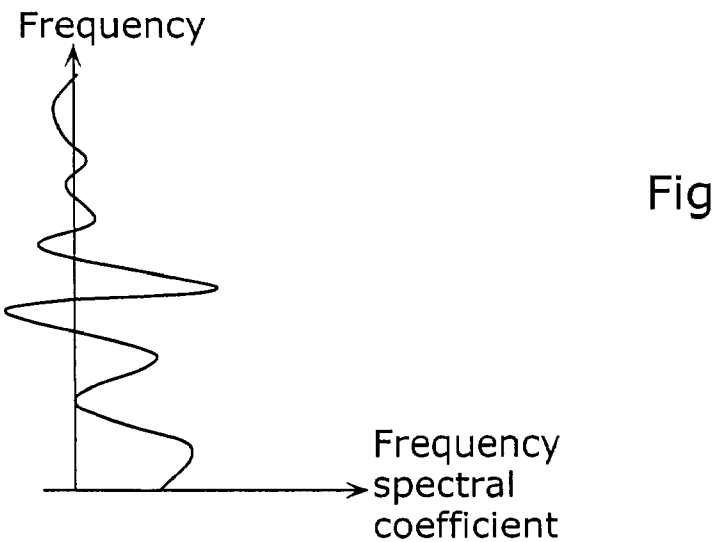
FIG. 5B is a diagram showing a frequency spectrum obtained by transforming the audio signal in the time domain in the sub-frame 1 shown in FIG. 5A into a signal in the frequency domain.
Figure 5C:
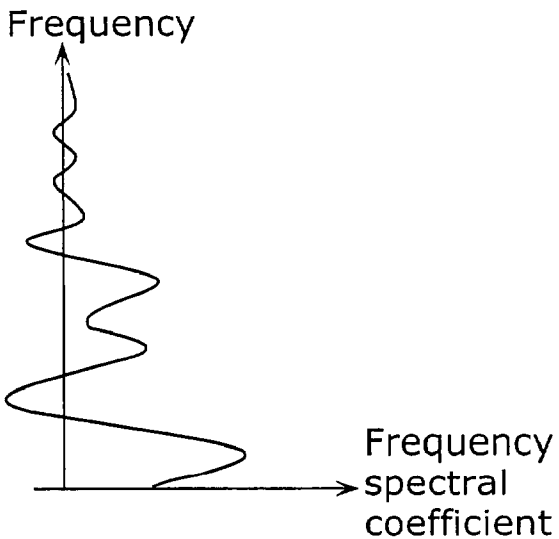
FIG. 5C is a diagram showing a frequency spectrum obtained by transforming the audio signal in the time domain in the sub-frame 2 shown in FIG. 5A into a signal in the frequency domain.

FIG. 5B is a diagram showing the frequency spectrum obtained by transforming the audio signal in the time domain of the sub-frame 1 shown in FIG. 5A into a signal in the frequency domain. FIG. 5C is a diagram showing the frequency spectrum obtained by transforming the audio signal in the time domain of the sub-frame 2 shown in FIG. 5A into a signal in the frequency domain. The transform from the time domain to the frequency domain is conducted by using only the audio signal in each sub-frame, and the signal in the frequency domain (the frequency spectrum) obtained by the transform is supposed to be completely restored to the original signal in the time domain by executing its inverse transform (frequency-time transform). There are discrete Fourier transform and discrete cosine transform available as such a frequency transforming method. Since these methods are known in the art, their explanation is omitted here.The MDCT transform mentioned previously is to transform a signal in the time domain in a frame having some temporal overlap with each other into a signal in the frequency domain. However it causes a delay for reconstructing the signal in the time domain, so that it is not used for the case of deriving the frequency spectrum in FIG. 5B and FIG. 5C. Due to the same reason causing a delay, a polyphase filter or the like is not used.

Since the frequency spectrum in the N-th frame in FIG. 5B and FIG. 5C is divided into the first half and the second half of the frame, the number of samples respectively contained in the sub-frame 1 and the sub-frame 2 equals to a half of the sample quantity in the frame. The number of samples for the frequency spectrum in FIG. 5A and FIG. 5B respectively equals to a half of the sample quantity in the frame, so that these diagrams show a change in a ratio of frequency components in the same band as the band shown in FIG. 4B at double intervals of the samples in a frequency axis direction. As shown in FIG. 4B, when the time-frequency transform is executed to the audio input signal in the frame at a time, the frequency spectrum which shows a ratio of the frequency components contained in the entire audio input signal in the frame is obtained. But as shown in FIG. 5B and FIG. 5C, if the audio input signal in the frame is divided into the first half and the second half they are respectively transformed according to the time-frequency transform, it becomes clear that the ratio of the frequency components contained in each part of the audio signal is different between the first half and the second half in the N-th frame of the audio input signal. That is to say, the frequency spectrum shown in FIG. 5B and FIG. 5C indicates a temporal change in the ratio of the frequency components of the audio signal in the first half and the second half of the N-th frame.

Figure 6A:
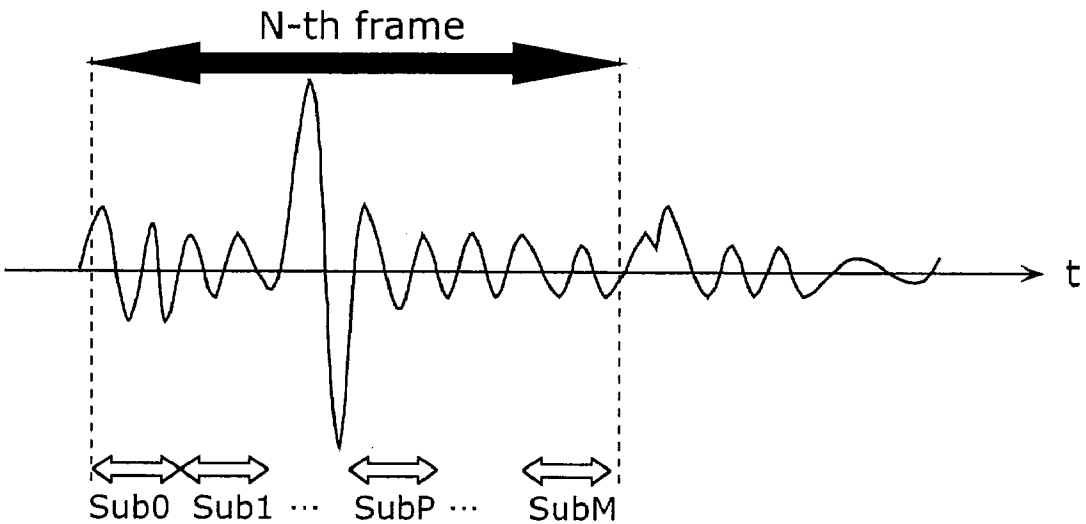
FIG. 6A is a diagram showing how the audio signal in the time domain (the N-th frame) same as FIG. 4A is divided into (M+1) pieces of sub-frames.
Figure 6B:
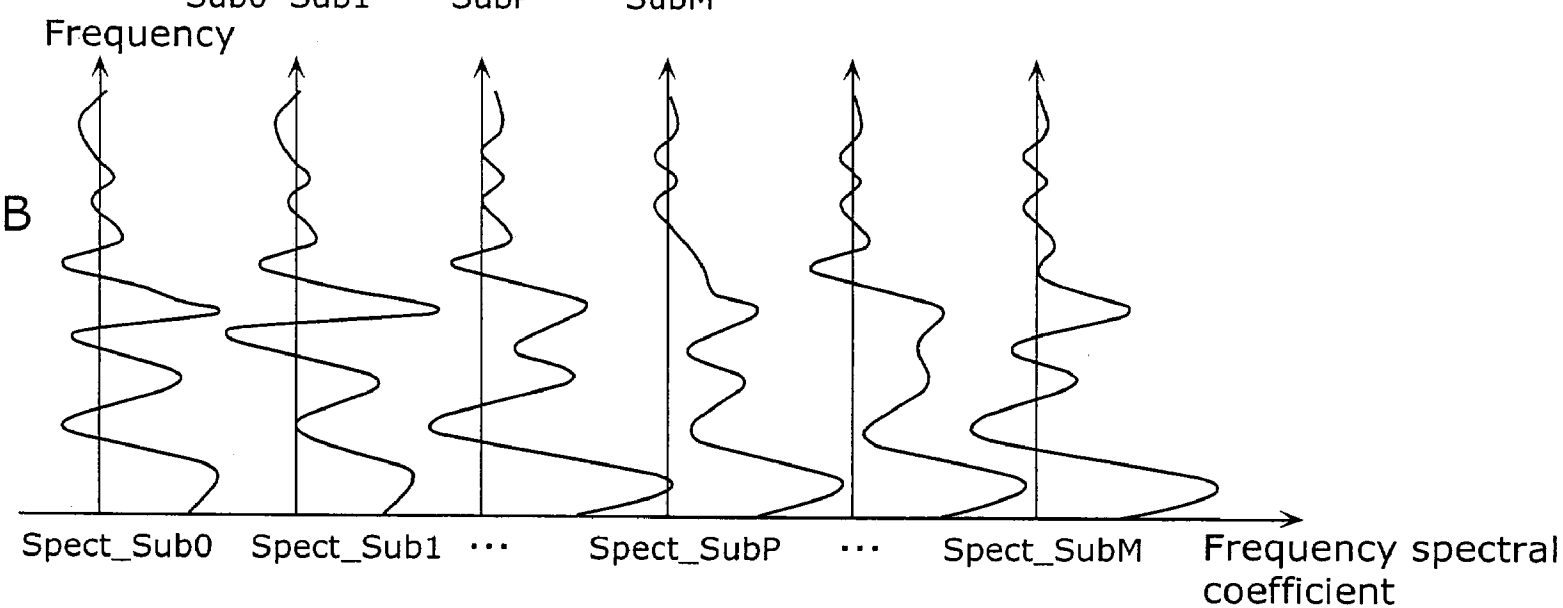
FIG. 6B is a diagram showing a frequency spectrum obtained by dividing the audio input signal in a frame into (M+1) pieces of sub-frames and executing the time-frequency transform by each sub-frame.

The aforementioned FIG. 5B and FIG. 5C show the example of the frequency spectrum for the case of dividing the N-th frame into two sub-frames and executing the time-frequency transform to each of the sub-frames. The following describes a case that the N-th frame is further divided into (M+1) pieces of smaller sub-frames with reference to FIG. 6A and FIG. 6B. FIG. 6A is a diagram showing how the audio signal (the N-th frame) in the time domain same as FIG. 4A is divided into (M+1) pieces of sub-frames. FIG. 6B is a diagram showing the frequency spectrum obtained by dividing the audio input signal in a frame into (M+1) pieces of sub-frames and executing the time-frequency transform to each of the sub-frames. In FIG. 6A and FIG. 6B, a signal SubP in the time domain of the sub-frame at a discretional location (e.g. a P-th location (P is an integer)) is transformed to a frequency spectral coefficient Spect_SubP consisting of at least the same number of samples or more. The following supposes it is transformed to the frequency spectrum composing the same number of samples to simplify the explanation. When (M+1) pieces of the frequency spectra (a frequency spectral coefficient Spect_SubO~a frequency spectral coefficient Spect_SubM) shown in FIG. 6B is compared with the frequency spectra shown in FIG. 5B and FIG. 5C, it indicates a temporal change in the frequency components of the N-th frame more in detail in the time axis direction though the sample intervals become wider in the frequency axis direction.

Figure 7A:
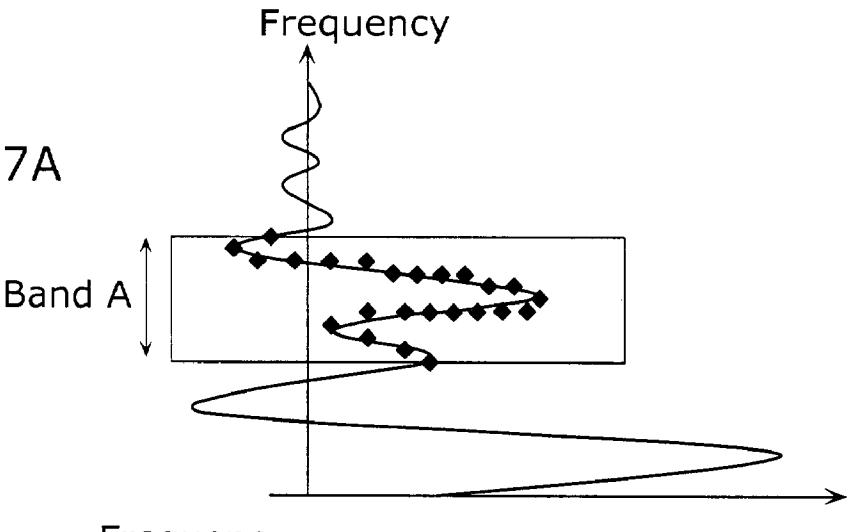
FIG. 7A is a diagram showing samples contained in a frequency band BandA on the frequency spectrum obtained by executing the time-frequency transform at a time to the audio signal in a frame.
Figure 7B:
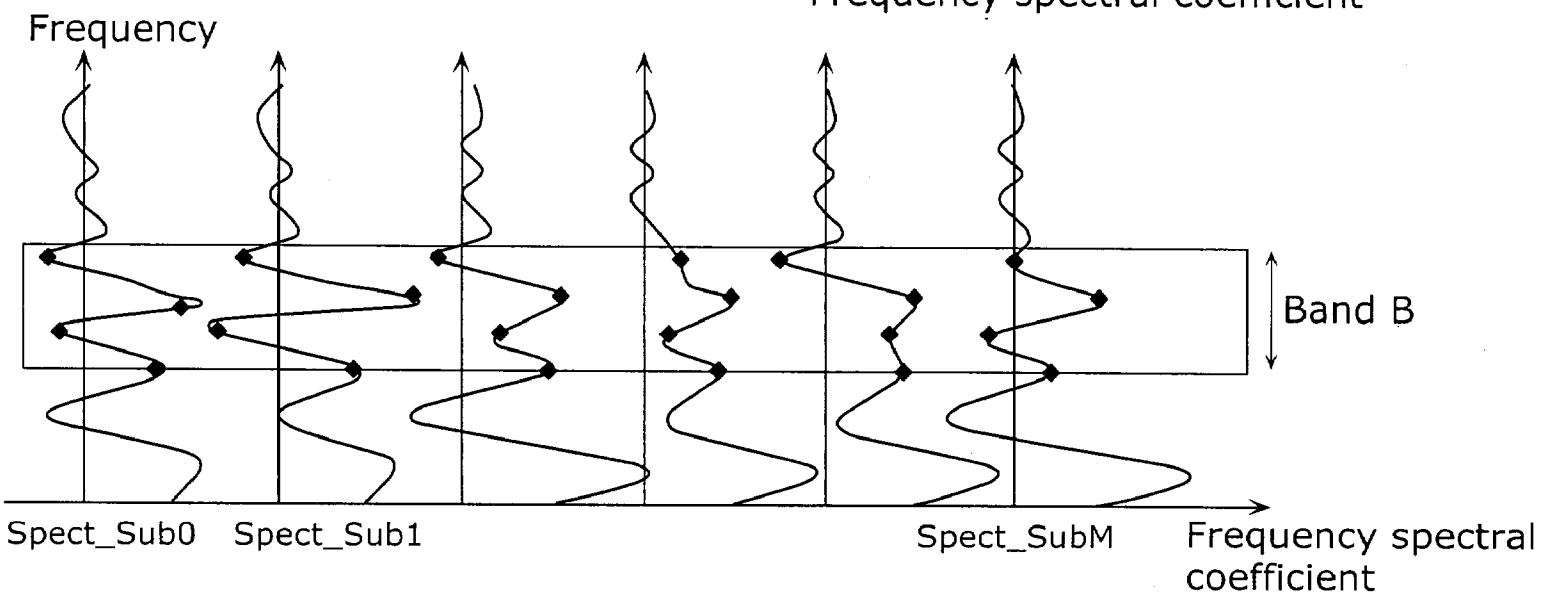
FIG. 7B is a diagram showing samples contained in a frequency band BandB on the frequency spectrum obtained by dividing the audio input signal in a frame into (M+1) pieces and executing the time-frequency transform to it by each sub-frame.

Next, the following describes how the frequency spectrum obtained by executing the time-frequency transform to the audio input signal in a frame is corresponded to the frequency spectrum obtained by executing the time-frequency transform by each sub-frame by using FIG. 7A and FIG. 7B. FIG. 7A is a diagram showing a sample contained in the frequency band BandA on the frequency spectrum obtained by executing the time-frequency transform at a time to the audio signal in the frame. The frequency spectrum of FIG. 7A is the same as the frequency spectrum shown in FIG. 4B. Also, FIG. 7B is a diagram showing a sample contained in the frequency band BandB on the frequency spectrum obtained by dividing the audio input signal in the frame into (M+1) pieces of sub-frames and executing the time-frequency transform by each sub-frame. That is to say, the frequency spectrum in FIG. 7B is the same as the frequency spectrum shown in FIG. 6B. The frequency band BandA for the frequency spectrum in FIG. 7A and the frequency band BandB for the frequency spectrum in FIG. 7B indicate the same frequency band region. That is to say, the number of samples contained in the frequency band BandA equals to the number of samples contained in the frequency band BandB in the entire frame. It indicates that data of the frequency spectral coefficient (black diamonds in the diagram) in the frequency band BandA of FIG. 7A is almost equivalent to the one of frequency spectral coefficients (black diamonds in the diagram) in all of the sub-frames in the frequency band BandB of FIG. 7B. Here, it is not necessary to obtain the frequency spectral coefficients, which are completely consistent with the frequency spectral coefficients in the frequency band BandB by executing the time transform to the frequency spectral coefficients in the frequency band BandA with a transform expression. It is important that the frequency spectral coefficient in the frequency band BandA is equivalent to the frequency spectral coefficient in the frequency band BandB. Therefore, it is possible to consider description of each sample (the frequency spectral coefficient) in the frequency BandA can be replaced by expressing the sample (the frequency spectral coefficient) in all of the sub-bands in the frequency band BandB. That is to say, in the encoding device 200 according to the first embodiment of the present invention, for the frequency band BandA where the time resolution ability is decided to prioritized, the frequency spectral coefficient in the frequency BandB is quantized and encoded instead of quantizing and encoding the frequency spectral coefficient of the frequency band BandA. That is to say, the time transforming unit 204 executes, for example, a transform expression, which is equivalent to an inverse transform (frequency-time transform) of DCT transform, to the frequency band BandA where the time resolution ability is decided to be prioritized among the frequency spectra obtained by the time-frequency transforming unit 201, and outputs a frequency spectral coefficient equivalent to all of the samples (the frequency spectral coefficients)in the frequency band BandB indicated in FIG. 7B.

Figure 8A:
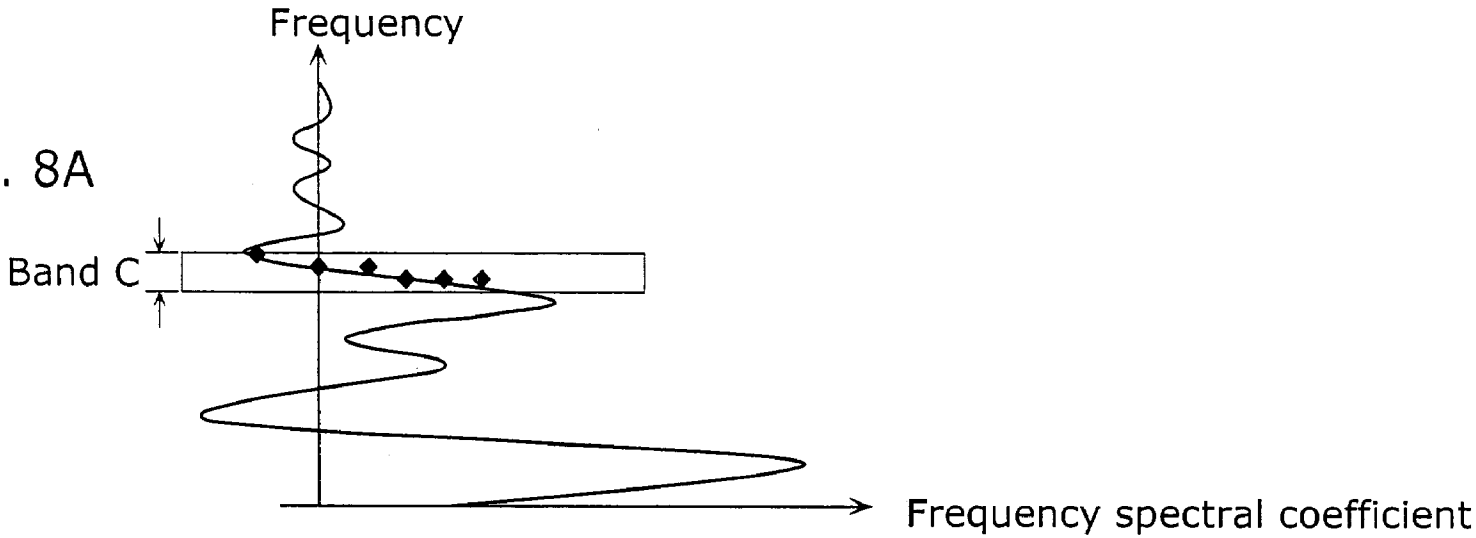
FIG. 8A is a diagram showing samples in a frequency band BandC on the frequency spectrum obtained by executing the time-frequency transform at a time to the audio signal in a frame.
Figure 8B:
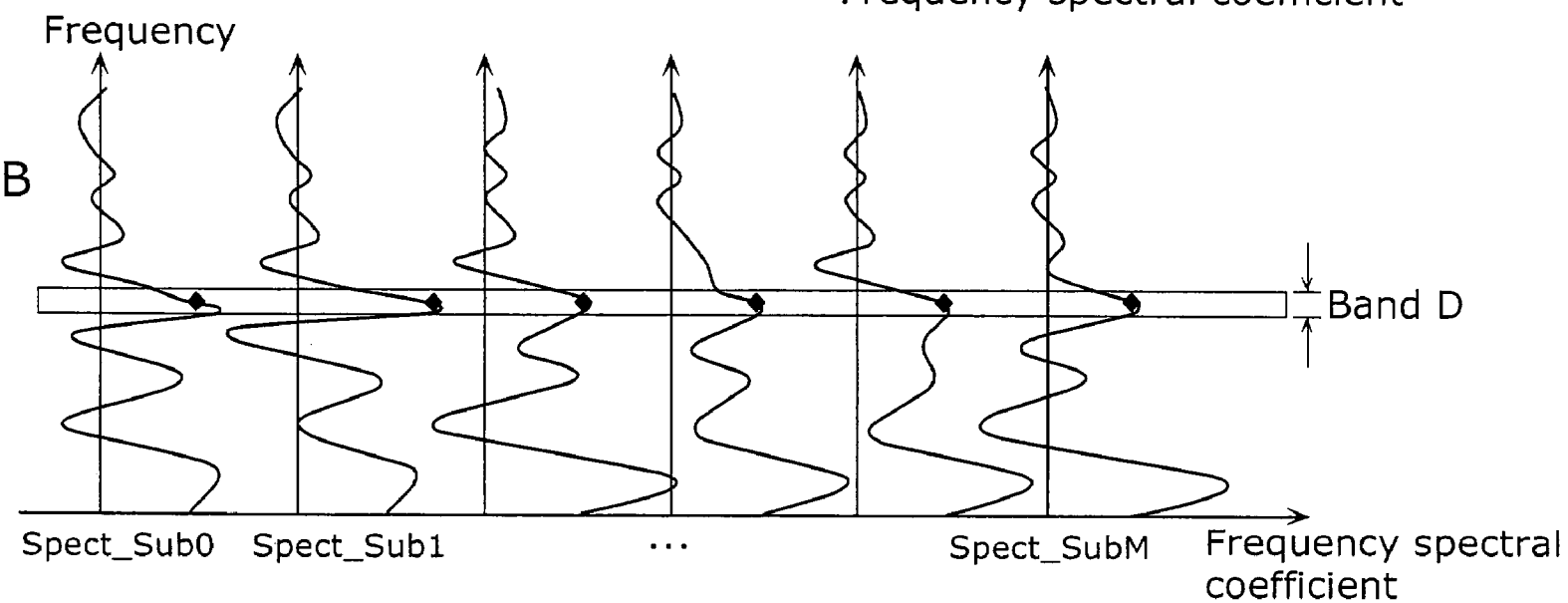
FIG. 8B is a diagram showing samples in a frequency band BandD on the frequency spectrum obtained by dividing the audio input signal in a frame into (M+1) pieces of sub-frames and executing the time-frequency transform to it by each sub-frame.

In accordance with the bandwidths of the frequency band BandA and the frequency band BandB indicated with FIG. 7A and FIG. 7B, for understanding the explanation better for the time transform method by the time transforming unit 204, the following describes the case when a bandwidth of the frequency band BandD is selected to have just a piece of the samples, which belongs to the frequency band BandD, in each sub-band, by using FIG. 8A and FIG. 8B. FIG. 8A is a diagram showing a sample in the frequency band BandC on the frequency spectrum obtained by executing the time-frequency transform to the audio signal in a frame. FIG. 8B is a diagram showing a sample in the frequency band BandD on the frequency spectrum obtained by dividing the audio input signal in a frame into (M+1) pieces of sub-frames and executing the time-frequency transform by each sub-frame. The frequency spectrum in FIG. 8A is the same as the frequency spectrum shown in FIG. 4B, and the frequency spectrum in FIG. 8B is the same as the frequency spectrum shown in FIG. 6 B. Also, the frequency band BandC in the frequency spectrum in FIG. 8A and the frequency band BandD in the frequency spectrum in FIG. 8B show the same frequency band. In FIG. 8B, when the frequency band BandD is selected to have a piece of the sample (the frequency spectral coefficient)that belongs to the frequency band BandD in each of (M+1) pieces of the sub-bands, the number of samples in the frequency band BandC, which is the same frequency band in the frequency spectrum shown in FIG. 8A is (M+1) pieces. Because each sample that belongs to the frequency band BandD shown in FIG. 8B is selected from each of (M+1) pieces of the sub-frames, if each sample is plotted by using the time on a horizontal axis and the frequency spectral coefficient on a vertical axis, it is possible to say that it indicates a temporal change in a frequency spectral coefficient that belongs the frequency band BandC in a frame of the audio signal.

Figure 9A:
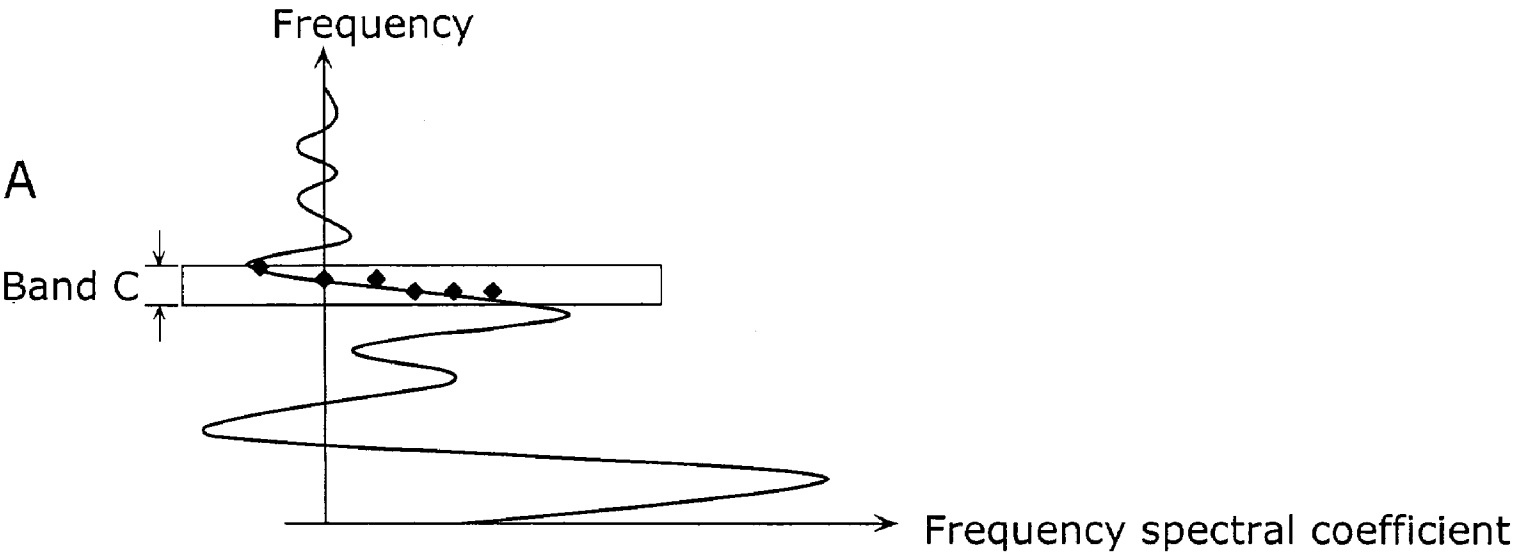
FIG. 9A is a diagram showing samples in a frequency band BandC on the frequency spectrum obtained by executing the time-frequency transform at a time to the audio signal in a frame.
Figure 9B:
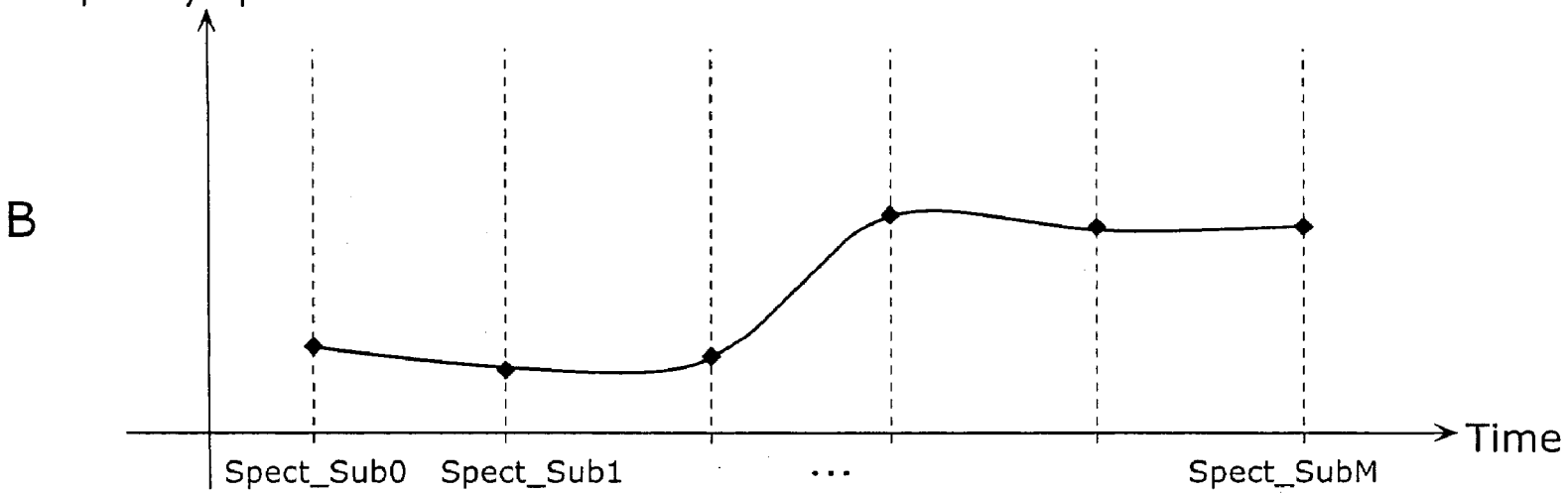
FIG. 9B is a diagram re-plotted for each sample (a frequency spectral coefficient) shown in FIG. 8B with using time on a horizontal axis and a frequency spectral coefficient on a vertical axis.

Similar to FIG. 8A, FIG. 9 A is a diagram showing a sample in the frequency band BandC on the frequency spectrum obtained by executing the time-frequency transform at a time to the audio signal in a frame. FIG. 9B is a diagram that each sample (a frequency spectral coefficient) shown in FIG. 8B is re-plotted by using the time on the horizontal axis and the frequency spectral coefficient value on the vertical axis. As already explained, the signal, which is made up of extracting one sample from each of (M+1) pieces of sub-frames in the same frequency band BandD, re-plotted as shown in FIG. 9B is equivalent to the time-frequency signal obtained by the time transform unit 204, and is the time-frequency signal that indicates a temporal change of the frequency spectral coefficient of the concerned frequency band BandD. As described, each sample (the frequency spectral coefficient) in the frequency band BandC shown in FIG. 9A can be treated as data almost same as the time frequency signal (the frequency band BandD) in FIG. 9B. Therefore, in the explanation hereinafter, to quantize the frequency spectral coefficient in FIG. 9A is indicated as "perform Qf", and to quantize the time-frequency signal in FIG. 9B is indicated as "perform Qt".

In the time transforming unit 204 shown in FIG. 2 within the encoding device 200 according to the first embodiment of the present invention, a part of the frequency spectral coefficient of the frequency spectrum obtained by the time-frequency transforming unit 201, i.e. the frequency spectral coefficient stream contained in the frequency band BandC in FIG. 9A is transformed to the time-frequency signal in the time domain in FIG. 9B. Going through this transform is equivalent to the transform from the frequency spectral coefficient stream contained in the frequency band BandC in FIG. 8A to the frequency spectral coefficient stream contained in the frequency band BandD in FIG. 8B, which is explained before. Or, it is equivalent to the transform from the frequency spectral coefficient stream in the frequency band BandA in FIG. 7A to the frequency spectral coefficient stream in the frequency band BandB in FIG. 7B.

The encoded data stream generating unit 205 shown in FIG. 2 quantizes and encodes the output from the time-frequency transforming unit 201 and the output from the time transforming unit 204, which is transformed as above, and outputs the encoded data stream. As to a concrete method of quantization and encoding in the encoded data stream generating unit 205, publicly known techniques such as the Huffman coding and the vector quantization are used.

Figure 10:
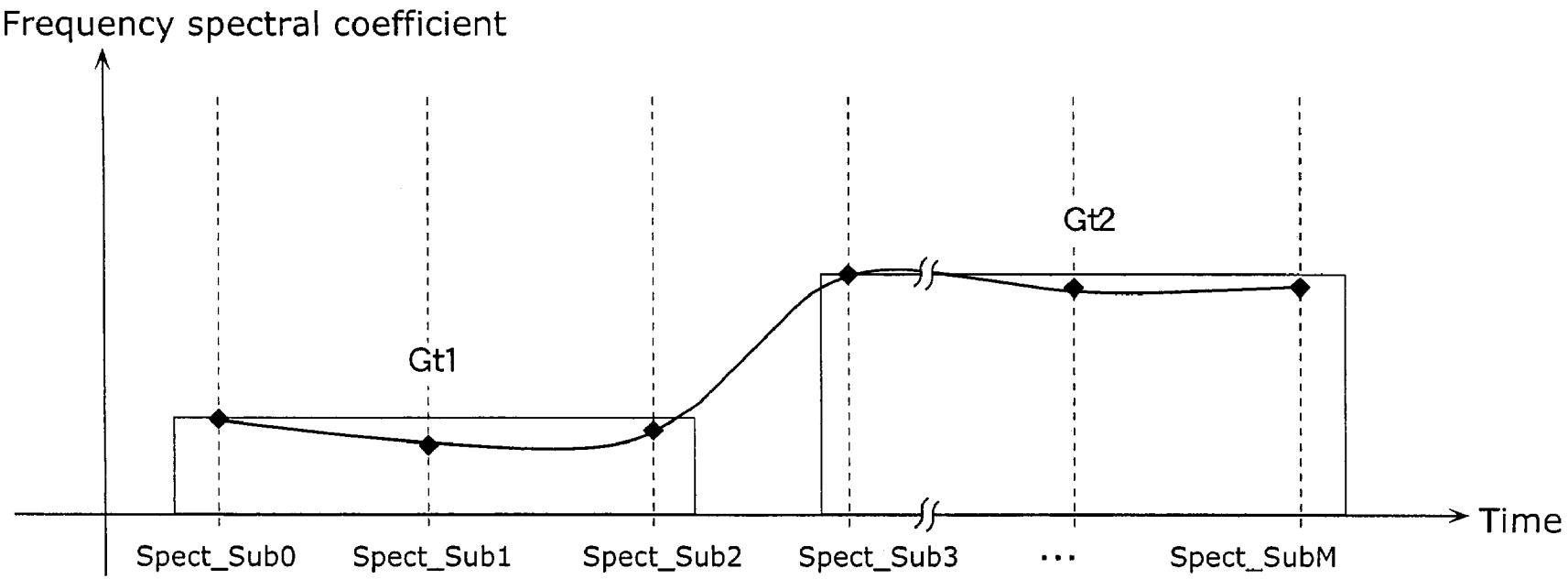
FIG. 10 is a diagram showing the encoding of a time-frequency signal by an encoded data stream generating unit shown in FIG. 2.

Also, the encoded data stream generating unit 205 may divide several pieces of samples of the time-frequency signal located in a part which has less fluctuation of amplitude into groups, and then quantize and encode its average gain for each of the groups. FIG. 10 is a diagram showing encoding of the time-frequency signal by the encoded data stream generating unit 205 shown in FIG. 2. As shown in FIG. 10, the encoded data stream generating unit 205, for example, finds an average gain Gt1 and an average gain Gt2 respectively for a sample group from a frequency spectral coefficient Spec_Sub 0 to a frequency spectral coefficient Spec_Sub 2 and a sample group from a frequency spectral coefficient Spec_Sub 3 to a frequency spectral coefficient Spec_Sub M, and quantizes and encodes data specifying each of the sample groups and the average gain in each of the groups in stead of quantizing and encoding the time-frequency signal itself from the frequency spectral coefficient Spec_Sub 0 to the frequency spectral coefficient Spec_Sub M. In this case, if the time-frequency signal is predefined to express, for example, as "a number of a first sample in the sample group, a number of a last sample in the sample group, an average gain in the sample group" between the encoding device 200 and a decoding device that decodes an encoded data stream output from the encoding device 200, the time-frequency signal shown in FIG. 10 can be expressed as two data groups, (0, 2, Gt1) and (3, M, Gt2). Also, in this case, it is not necessary to group all of each sample for the time-frequency signal. It may group samples only in a part having less fluctuation of the amplitude. For the part having a radical fluctuation of the amplitude, the frequency spectral coefficient value itself in each sample may be quantized and encoded.

Figure 11:
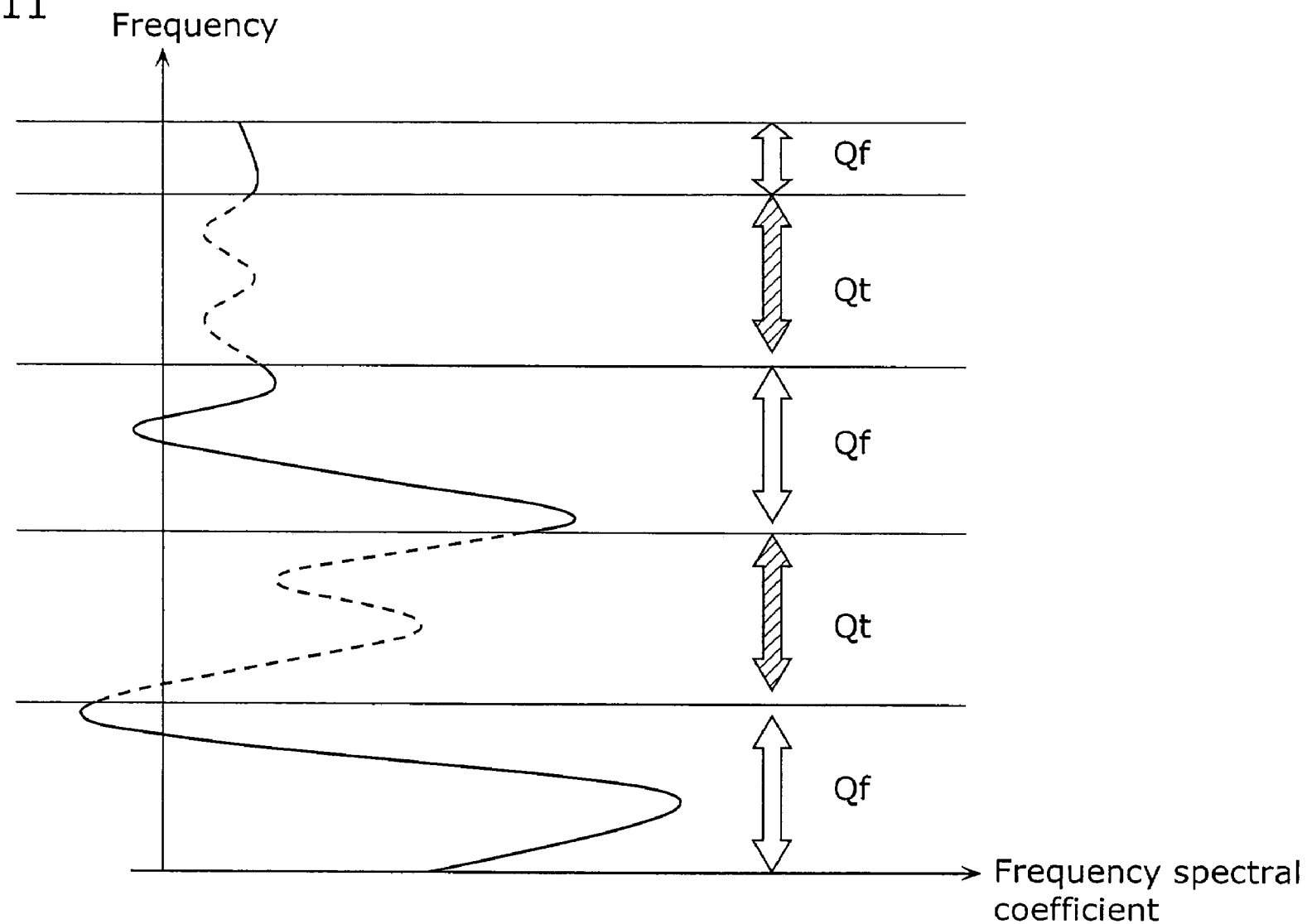
FIG. 11 is a diagram showing how an output signal of the time-frequency transforming unit is corresponded to data indicating bands transformed by a time transforming unit according to time transform.

Moreover, in the encoded data stream generating unit 205, data indicating which band is time-transformed is output with the encoded data stream among the output of the time-frequency transforming unit 201. FIG. 11 is a diagram showing how an output signal of the time-frequency transforming unit 201 is corresponded to the data indicating the band time-transformed by the time transforming unit 204. In the same diagram, the vertical axis shows the frequency and the horizontal axis shows the frequency spectral coefficient corresponding to the frequency on the vertical axis. In the case the MDCT transform is used in the time-frequency transforming unit 201, the frequency spectral coefficient indicates the MDCT coefficient in the same diagram. Also, in the frequency spectrum, which is an output signal of the time-frequency transforming unit 201, a part shown in a dotted line is the part that is not quantized and encoded by the encoded data stream generating unit 205. In stead, in the encoded data stream generating unit 205, the time-frequency signal corresponding to this band is quantized and encoded. The same diagram describes an example for a case that a frequency axis direction is divided into 5 bands, and the quantization is carried out in an order of Qf, Qt, Qf, Qt and Qf from its low frequency. In this way, the encoded data stream output from the encoded data stream generating unit 205 includes at least data indicating whether each of the bands is quantized and encoded in the time domain or in the frequency domain, and data quantized and encoded in each of the bands. The number of band divisions and the quantization method for each band (i.e. whether Qf or Qt) in the encoding device 200 are not fixed, and they are not limited to this example.

Figure 12:
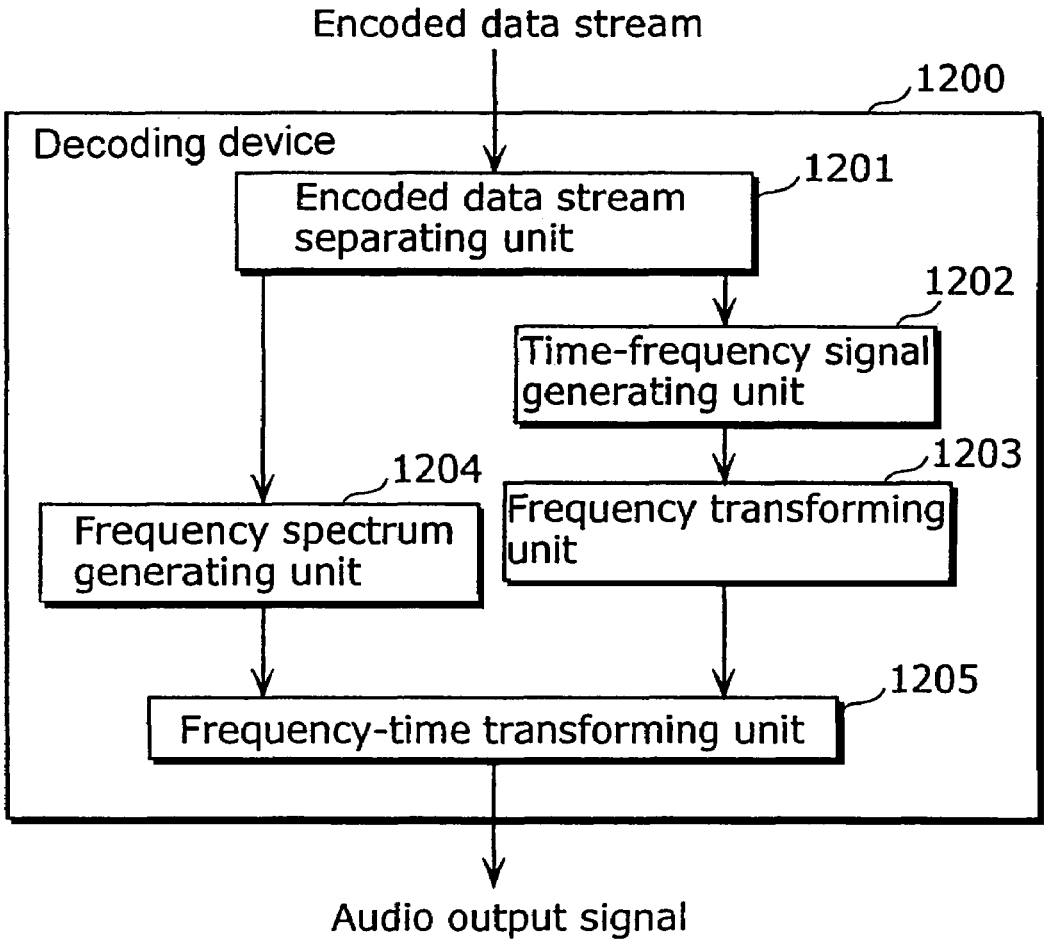
FIG. 12 is a block diagram showing the structure of the decoding device according to the first embodiment of the present invention.

FIG. 12 is a block diagram showing the structure of a decoding device 1200 according to the first embodiment of the present invention. This decoding device 1200 is a decoding device that decodes the encoded data stream output by the encoding device 200, and outputs an audio signal having an advanced level of the time resolution ability, which includes an encoded data stream separating unit 1201, a time-frequency signal generating unit 1202, a frequency transforming unit 1203, a frequency spectrum generating unit 1204 and a frequency-time transforming unit 1205. The encoded data stream separating unit 1201 separates encoded data in a band indicated as "Qf" and encoded data in a band indicated as "Qt" from an encoded data stream as an input signal, outputs the encoded data in the band indicated as "Qf" to the frequency spectrum generating unit 1204, and outputs the encoded data in the band indicated as "Qt" to the time-frequency signal generating unit 1202. The encoded data in the band indicated as "Qf" is data quantized and encoded in the frequency domain in the encoding device 200. The encoded data in the band indicated as "Qt" is data quantized and encoded in the time domain in the encoding device 200.

The frequency spectrum generating unit 1204 decodes the input encoded data, further inverse-quantizes it, and generates a frequency spectrum on the frequency axis. On the other hand, the time-frequency signal generating unit 1202 decodes the input encoded data, inverse-quantizes it, and temporally generates a time-frequency signal on the time axis. The temporally generated time-frequency signal is input to the frequency transforming unit 1203. The frequency transforming unit 1203 transforms the input time-frequency signal from the frequency spectral coefficient in the time domain to the frequency spectral coefficient in the frequency domain based on a unit of a number of samples less than the ones in a frame by using a transform expression equivalent to inverse transform of the transform expression used by the time transforming unit 204 of the encoding device 200. Data, which indicates a temporal change expressed in the time-frequency signal, is reflected on the frequency spectral coefficient obtained as a result of the partial transform to the frame according to above, and this frequency spectral coefficient is output to the frequency-time transforming unit 1205. In the frequency-time transforming unit 1205, the frequency spectrum in the frequency domain, which is an output signal from the frequency spectrum generating unit 1204 and the frequency transforming unit 1203, is composed on the frequency axis, and transformed to an audio signal on the time axis. In this way, a time component expressed by the time-frequency signal can be reflected on the frequency spectrum output from the frequency spectrum generating unit 1204, and an audio signal having high time resolution ability can be obtained. In the frequency-time transforming unit 1205, a transform method, which is an inverse process of the time-frequency transforming unit 201 conducted in the encoding device 200, is used. For example, if the MDCT transform is used in the time-frequency transforming unit 201 in the encoding device 200, inverse MDCT transform is used in the frequency-time transforming unit 1205. The output of the frequency-time transforming unit 1205 obtained in this way is, for example an audio output signal expressed by a discrete temporal change in a voltage.

As mentioned above, according to the encoding device 200 and the decoding device 1200 in the first embodiment of the present invention, it is possible to select whether an audio signal in a certain time frame for a discretional band is encoded in the time domain or in the frequency domain. Therefore, this method provides possibility of more flexible and more efficient data encoding rather than the encoding method only in the frequency domain or the encoding method only in the time domain. As a result, this method enables a lot of data in a given amount of data to be encoded and achieve a high quality of the reproduced audio signal.

Although the time characteristic extracting unit 203, in the first embodiment, decides the time resolution ability should be prioritized when a change in the average energy between sub-frames (i.e. a difference between adjacent sub-frames) is bigger than the predefined threshold value, a decision criterion for the time characteristic extracting unit 203 to decide whether the time resolution ability is prioritized or the frequency resolution ability is prioritized is not limited to the above method. Also, in the above embodiment, though the frequency characteristic extracting unit 202 decides the quantization in the time domain should be carried out to the band where the adjoined frequency spectral coefficients spread widely in the frequency spectrum, or the band where negative and positive codes are frequently switched, a decision criterion for this decision is not limited to the above method, either.

Second Embodiment

The following describes a second embodiment of the present invention. Methods of the quantization and the encoding in the second embodiment are different from the ones in the first embodiment. In the first embodiment, for the audio input signal transformed into the frequency domain by each frame, the one in a certain band in the frame is quantized as it is, but the one in another band is re-transformed into the time domain and then the signal in the time domain is quantized. In the second embodiment of the present invention, rather than carrying out quantization and encoding only with the signal in the selected band, quantization and encoding are performed by the signal in other band.

Figure 13:
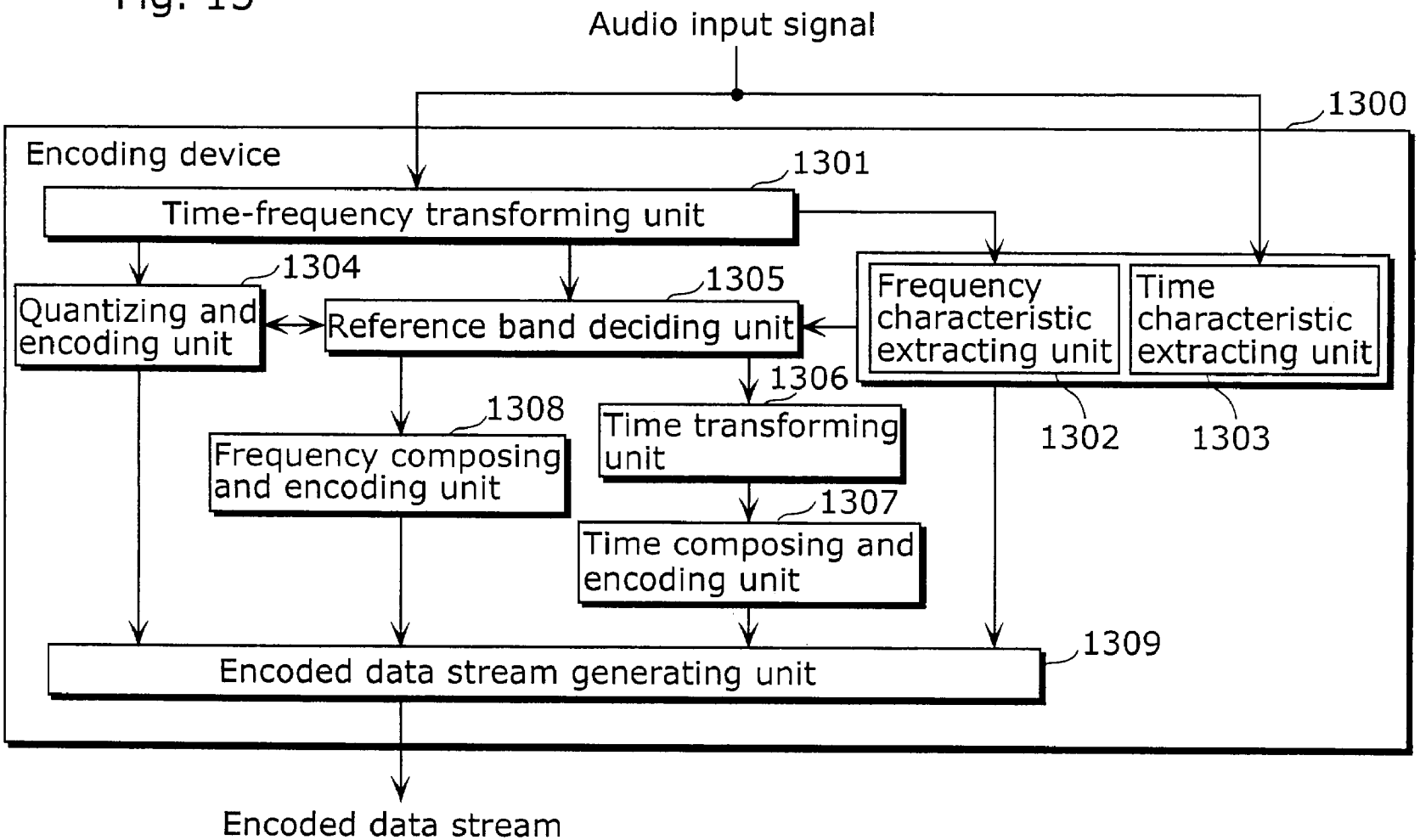
FIG. 13 is a block diagram showing the structure of the encoding device according to a second embodiment of the present invention.

FIG. 13 is a block diagram showing the structure of an encoding device 1300 according to the second embodiment of the present invention. The encoding device 1300 includes a time-frequency transforming unit 1301, a frequency characteristic extracting unit 1302, a time characteristic extracting unit 1303, a quantizing and encoding unit 1304, a reference band deciding unit 1305, a time transforming unit 1306, a time composing and encoding unit 1307, a frequency composing and encoding unit 1308 and an encoded data stream generating unit 1309. In the same diagram, the time-frequency transforming unit 1301, the frequency characteristic extracting unit 1302, the time characteristic extracting unit 1303 and the time transforming unit 1306 are almost identical to the time-frequency transforming unit 201, the frequency characteristic extracting unit 202, the time characteristic extracting unit 203 and the time transforming unit 204 respectively in the encoding device 200 shown in FIG. 2.

The audio input signal is input to the time-frequency transforming unit 1301 and the time characteristic extracting unit 1303 by each frame of a certain time length. The time-frequency transforming unit 1301 transforms the input signal in the time domain into a signal in the frequency domain. The time-frequency transforming unit 1301, for example obtains an MDCT coefficient using the MDCT transform.

The frequency characteristic extracting unit 1302 analyzes a frequency characteristic of the frequency spectral coefficient transformed by each frame, which is the output of the time-frequency transforming unit 201, and specifies a band that is better to be quantized with giving the time resolution ability priority in the same way as the frequency characteristic extracting unit 202 in FIG. 2.

In the same way as the time characteristic extracting unit 203 in FIG. 2, the time characteristic extracting unit 1303 decides whether the time resolution ability should be prioritized or the frequency resolution ability should be prioritized to quantize the audio signal input per each frame. In the time characteristic extracting unit 1303, because it is not necessary to quantize and encode all of the bands for the input signal with the same time resolution ability or the same frequency resolution ability, the decision can be made by each sub-frame or by each frequency band.

For the signal (the frequency spectral coefficient) in the frequency domain obtained by the time-frequency transforming unit 1301, the quantizing and encoding unit 1304 quantizes and encodes signal by each predefined band. This quantizing and encoding unit 1304 quantizes and encodes data using publicly known techniques that are known in the art such as the venctor quantization and the Huffman coding. The quantizing and encoding unit 1304 internally contains a memory not shown in the drawing holds an encoded data stream that has been encoded already and a frequency spectrum before encoding in its memory, and outputs the encoded data stream or the frequency spectrum before encoding in the band decided by the reference band deciding unit 1305 to the reference band deciding unit 1305.

According to decision results of the frequency characteristic extracting unit 1302 and the time characteristic extracting unit 1303, the reference band deciding unit 1305 decides a band that should be referred for the band specified by the frequency characteristic extracting unit 1302 and the time characteristic extracting unit 1303 in the encoded data stream as the output of the quantizing and encoding unit 1304. To be specific, for the bands specified by the time characteristic extracting unit 1303, the reference band deciding unit 1305 quantizes and encodes only the first specified band, without referring to other band, in the time domain and encodes the rest of the bands in the time domain with reference to the frequency spectrum in the band. Moreover, for the bands specified by the frequency characteristic extracting unit 1302, if a frequency spectral coefficient equivalent to a signal component in multiples of an integer (i.e. in a relationship of harmonic overtone) is contained among the bands specified by the frequency characteristic extracting unit 1302, the reference band deciding unit 1305 quantizes and encodes, in the frequency domain, for example, only the band containing a component (the frequency spectral coefficient)in the lowest frequency among the bands including the frequency spectral coefficient. For example, if the frequency components of 8 kHz, 16 kHz and 24 kHz are contained respectively in the bands specified by the frequency characteristic extracting unit 1302, only the band containing the frequency component of 8 kHz is quantized and encoded. Regarding any bands other than that, e.g. the band containing the frequency component of 16 kHz and the band containing the frequency component of 24 kHz, they are decided to be encoded in the frequency domain with reference to the band containing the component (the frequency spectral coefficient) of the lowest frequency (8 kHz) as a referred band. If the frequency spectral coefficient equivalent to harmonic overtone among the bands specified by the frequency characteristic extracting unit 1302 is not contained, the frequency characteristic extracting unit 1302 decides to quantize and encode these bands in the time domain without reference to other band.

Figure 14:
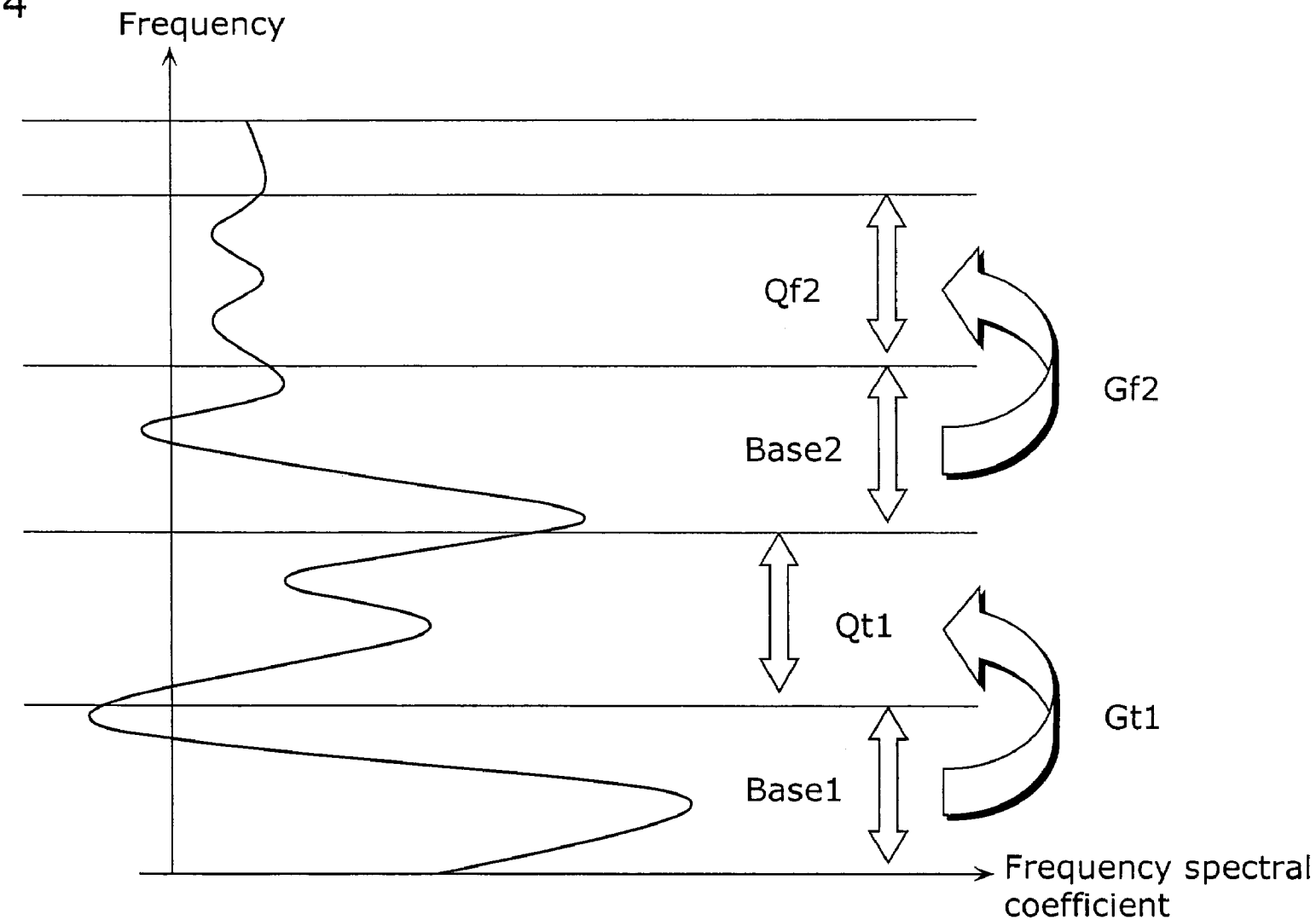
FIG. 14 is a diagram showing an example of a method generating an encoded data stream in a target band with reference to other band.

Next, actions of the reference band deciding unit 1305 are described with reference to FIG. 14 to 16. FIG. 14 is a diagram showing an example of a method for generating an encoded data stream of a target band with reference to other band. The vertical axis shows a frequency and the horizontal axis shows a frequency spectral coefficient value for the frequency on the diagram. In FIG. 14, both of a frequency band Base1 and a frequency band Base2 are a part of a band of which coefficient of its frequency domain signal (a frequency spectrum) has already been quantized and encoded by the quantizing and encoding unit 1304. On the other hand, the signal in the bands indicated as "Qt1" and "Qt2" are meant to be the ones quantized and encoded by using the frequency spectral coefficients of the frequency band Base1 and of the frequency band Base2 respectively. For example, "Qt1" means to be quantized and encoded according to the time domain transform using the signal of the frequency band Base1, and the band "Qf2" means to be quantized and encoded in the frequency domain using the signal of the Base2. Moreover, a parameter for expressing "Qt1" with use of the band signal of Base1 is defined as a parameter Gt1, and a parameter for expressing "Qf2" with use of the band signal of the frequency band Base2 is defined as a parameter Gf2. It means the signal in the band "Qt1" is quantized and encoded by the signal in the band of the frequency band Base1 expressed in the time domain with the parameter indicated as the parameter Gt1, and the signal in the band "Qf2" is quantized and encoded by the signal in the band of Base2 expressed in the frequency domain (but the transform is not needed because it is already expressed in the frequency domain), with the parameter indicated as the parameter Gf2. However, a method for dividing the band, its sequence and quantity are not limited to these.

Figure 15:
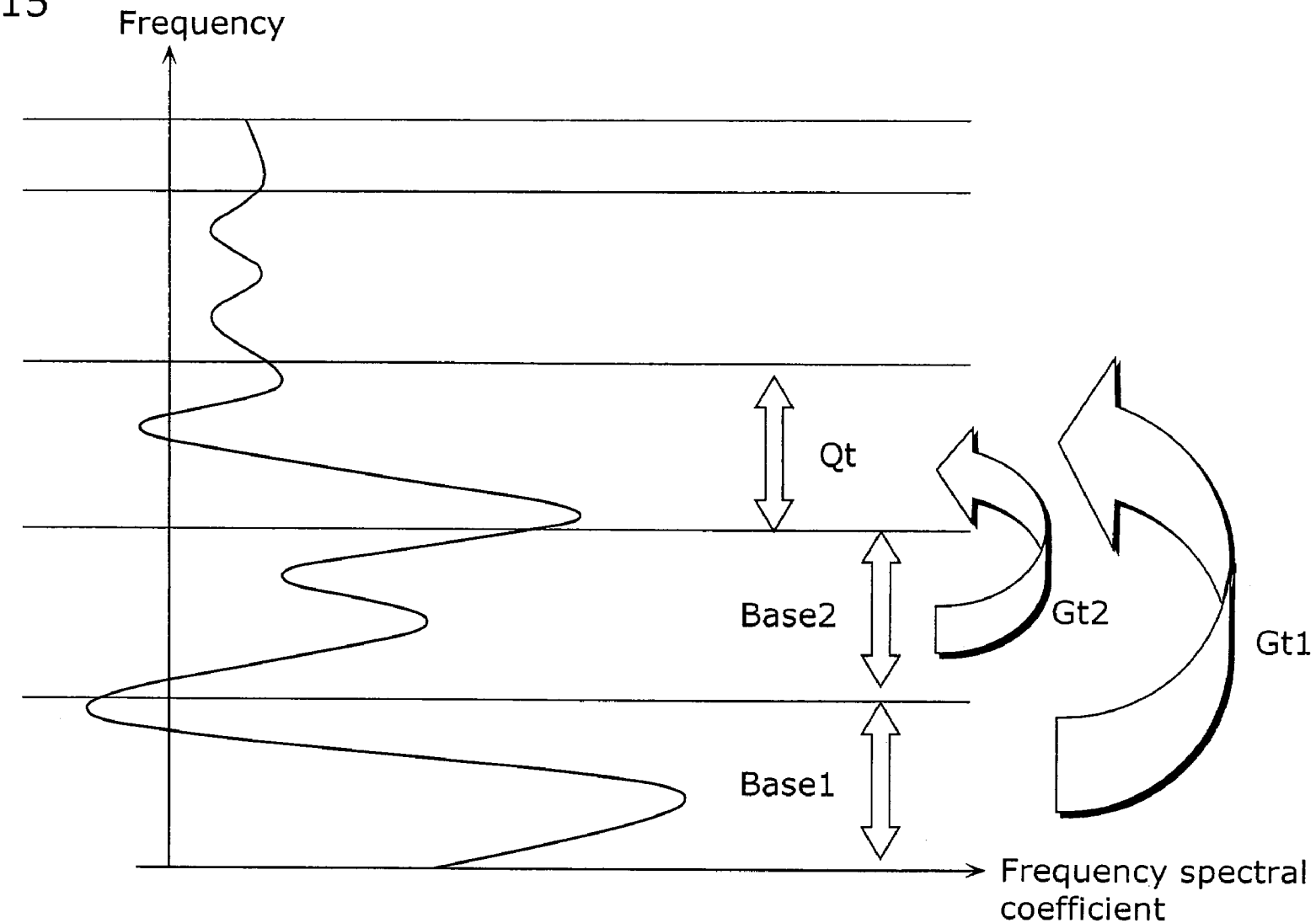
FIG. 15 is a diagram showing another example of the method generating the encoded data stream in the target band with reference to other band.
Figure 16:
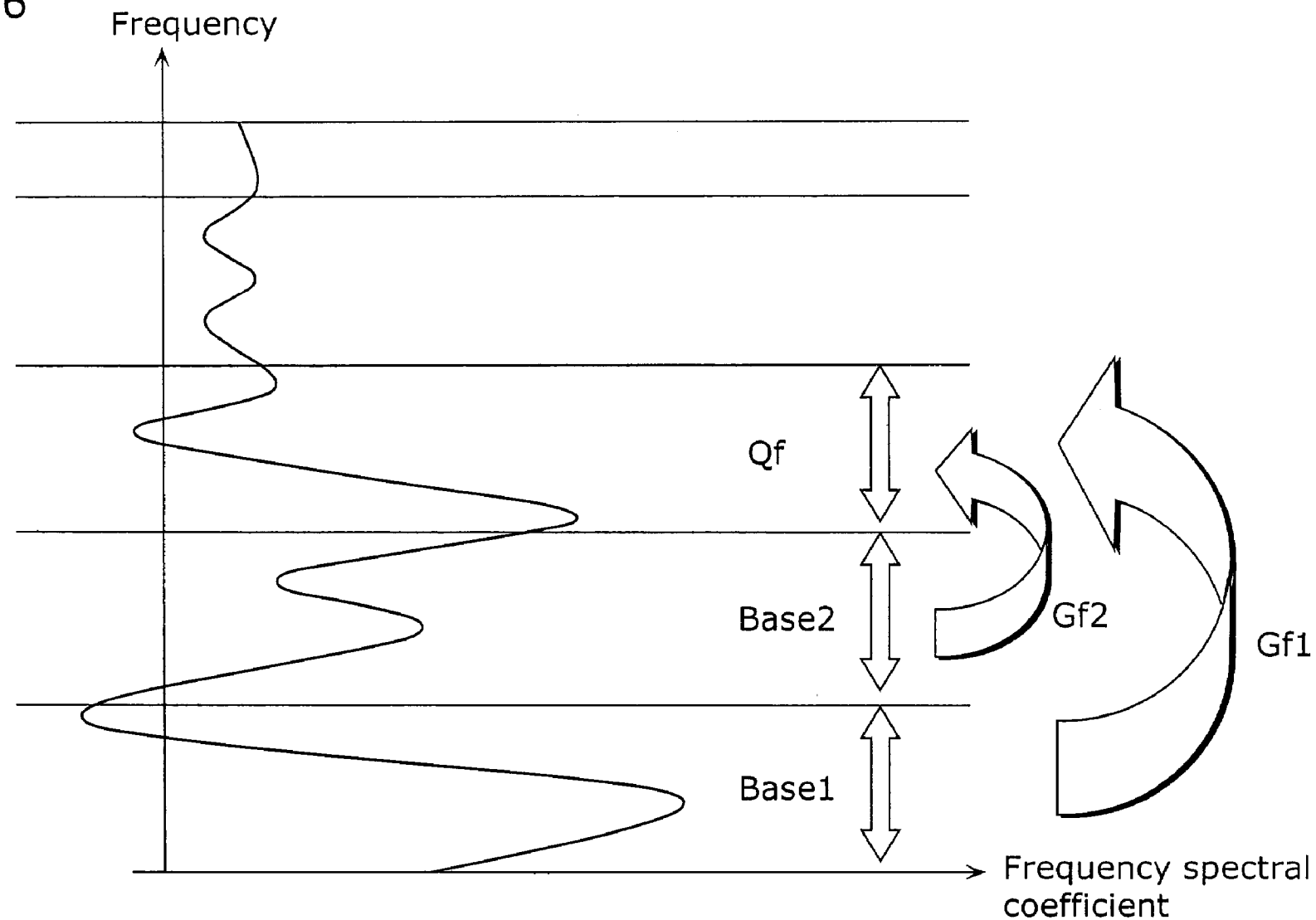
FIG. 16 is a diagram showing other example of the method generating the encoded data stream in the target band with reference to other band.

FIG. 15 is a diagram showing another example of the method for generating the encoded data stream of the target band with reference to other band. Just like the case of FIG. 15, a signal of "Qt" may be expressed by a sum of addition by using both of two bands (expressed in the time domain) of the frequency band Base1 and the frequency band Base2 that have already been quantized and encoded in the quantizing and encoding unit 1304, with the parameter Gt1 and the parameter Gt2 respectively. FIG. 16 is a diagram showing other examples of the method for generating the encoded data stream of the target band with reference to other band. In FIG. 16, a signal of "Qf" may be expressed by a sum of addition by using both of two bands (expressed in the frequency domain) of the frequency band Base1 and the frequency band Base2 that have already been quantized and encoded in the quantizing and encoding unit 1304 with the parameter Gf1 and the parameter Gf2 respectively. Either of the cases in FIG. 15 and FIG. 16 illustrates the case a certain frequency band is quantized and encoded by using the signal in two bands that have already been quantized and encoded, but the number of bands is not limited to two. In the reference band deciding unit 1305, a band subject for quantization and encoding (the target band) specified by the time characteristic extracting unit 203 among the frequency spectral coefficients in a frame is expressed by using either of the bands (the referred band) that are quantized and encoded by the quantizing and encoding unit 1304, and whether quantization and encoding are carried out to it or not is decided.

Figure 17:
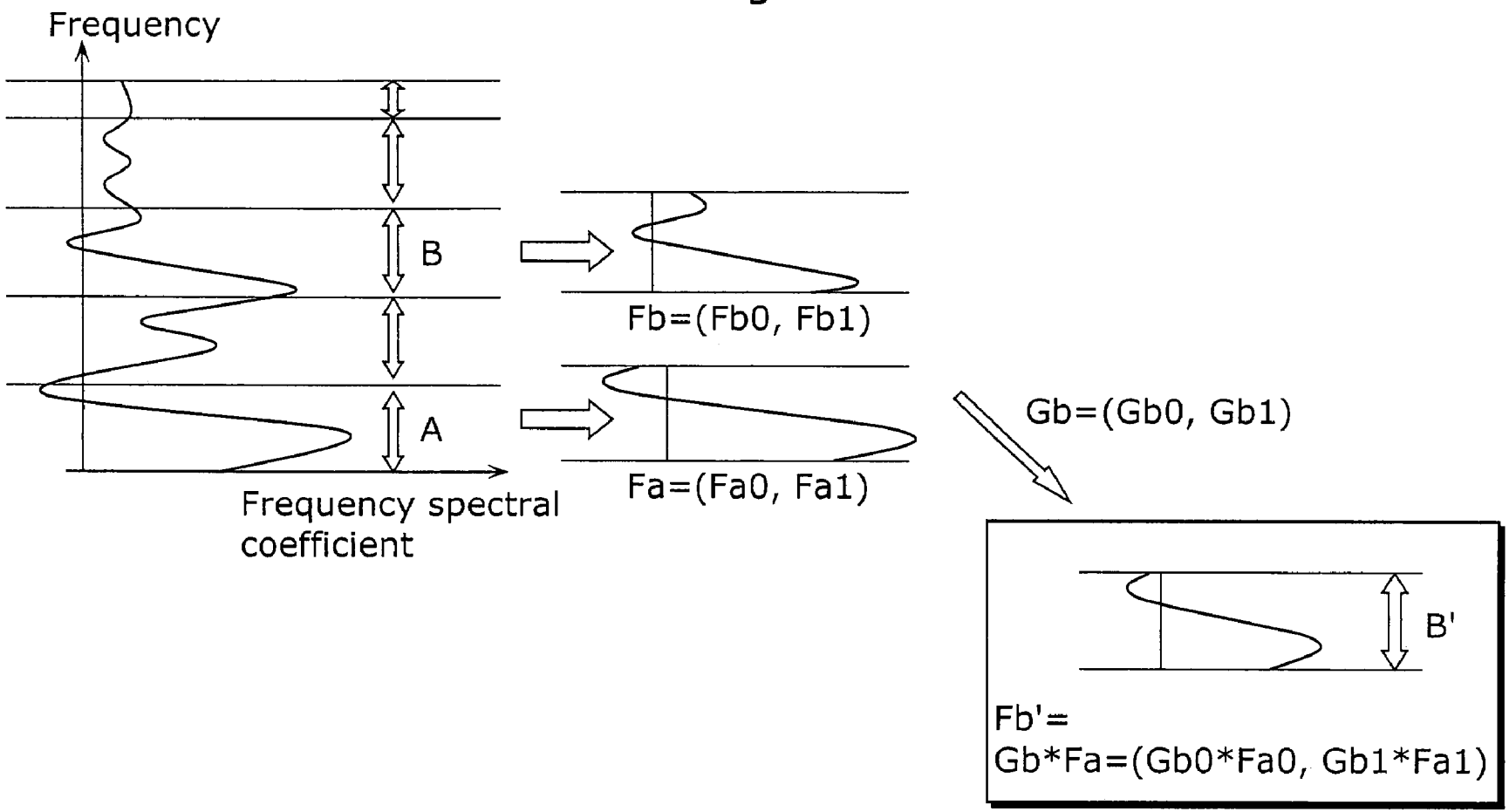
FIG. 17 is a diagram showing an example of a method that a frequency spectrum in a target domain is composed in a frequency domain by using an encoded data stream in a referred band, which is already quantized and encoded.

Next, the frequency composing and encoding unit 1308 is explained with reference to FIG. 17. FIG. 17 is a diagram showing an example of a method for which a frequency spectrum in a target domain is composed in the frequency domain by using the encoded data stream in the referred band that has already been quantized and encoded. As described above, suppose the signals in the referred band and in the target band have been selected by the reference band deciding unit 1305. In FIG. 17, a band A is the referred band and a band B is the target band. To simplify the explanation, the signal in the band A and the signal in the band B respectively consist of the same number of elements, and each is respectively described as a vector Fa and a vector Fb. Additionally, each vector is divided into two, i.e. the vector Fa=(Fa0, Fa1) and vector Fb=(Fb0, Fb1). Fa0, Fa1, Fb0 and Fb1 are a vector. The number of elements of Fa0 is the same as the number of elements of Fb0, and the number of elements of Fa1 is the same as the number of elements of Fb1. The number of elements of Fa0 may or may not be the same as the number of elements of Fa1. A parameter Gb=(Gb0, Gb1) is defined. The parameter Gb is a vector, but Gb0 and Gb1 are a scalar value. A vector Fb', which is an approximation of the vector Fb is defined as the following formula by using the vector Fa and the parameter Gb.

$$Fb'=Gb*Fa=(Gb0*Fa0,Gb1*Fa1) \quad \text{[Formula 1]}$$

In the way like this, the signal in the frequency domain for the target band B is composed by getting a product from the signal in the frequency domain for the target band A multiplied by the parameter Gb that controls a composing ratio. Moreover, the frequency composing and encoding unit 1308 quantizes and encodes data showing which referred band expresses a specific target band and the parameter Gb used for a gain control over the referred band. To simplify the explanation, the case that the target band and the referred band are divided into two vectors has been described. But they may be divided into less or more than two. And, dividing a band may or may not be even.

Figure 18:
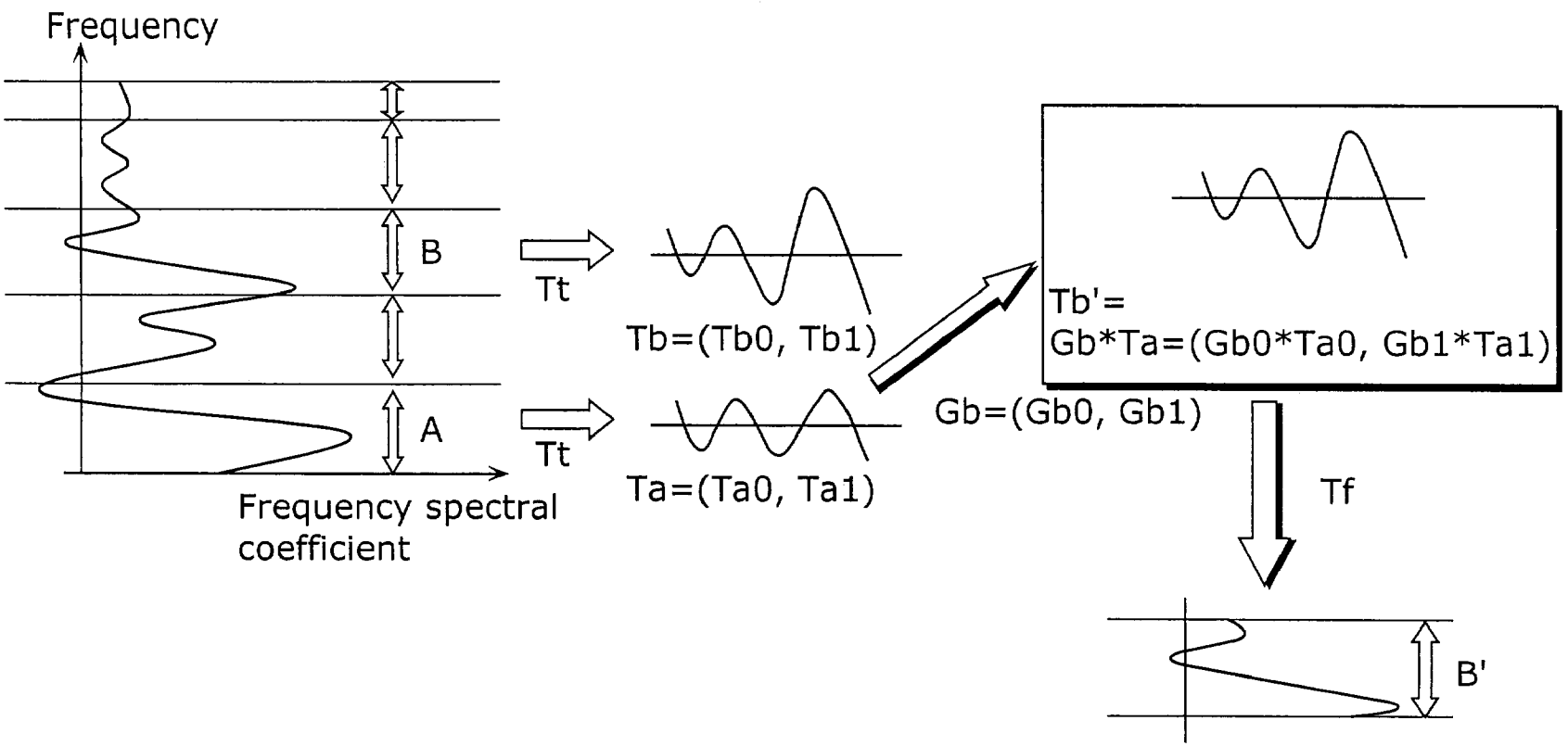
FIG. 18 is a diagram showing an example of a method that a frequency spectrum in a target domain is composed in a time domain by using an encoded data stream in a referred band, which is already quantized and encoded.
Figure 19A:
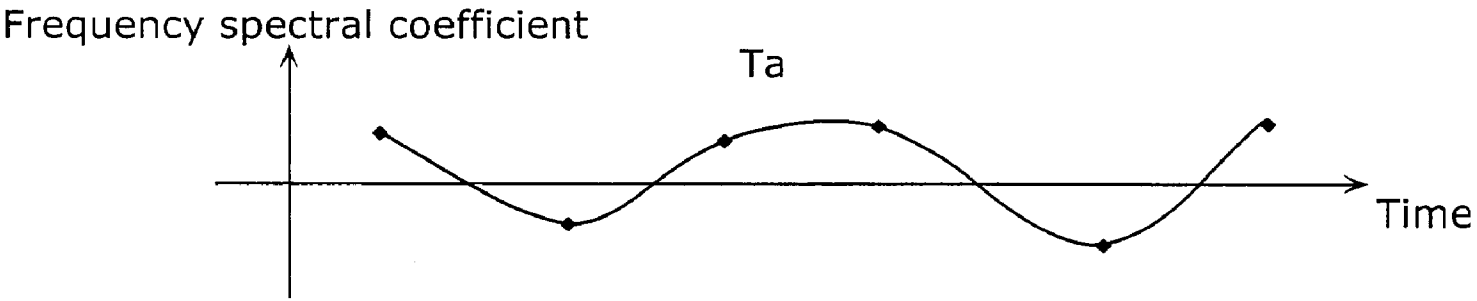
FIG. 19A is a diagram showing a vector Ta indicating a signal obtained by transforming a signal in the frequency domain of a band A, which is a referred band, to the one in the time domain.
Figure 19B:
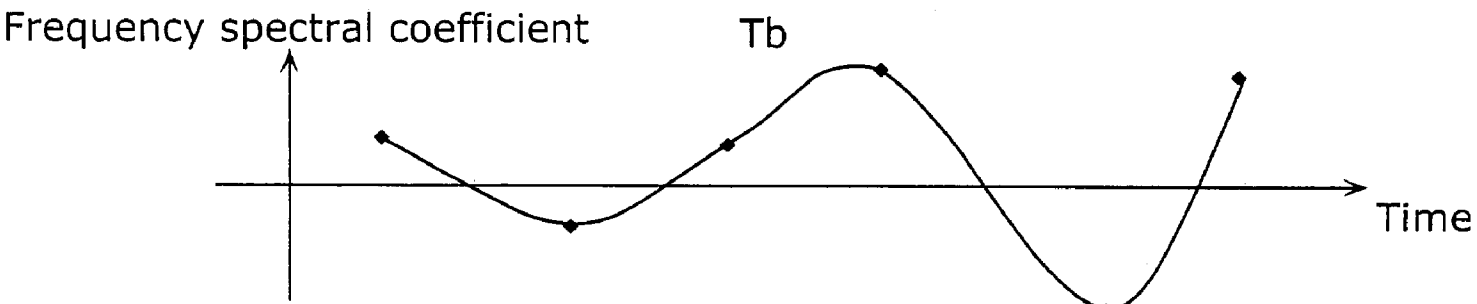
FIG. 19B is a diagram showing a vector Tb indicating a signal obtained by transforming a signal in the frequency domain of a band B, which is a referred band, to the one in the time domain.
Figure 19C:
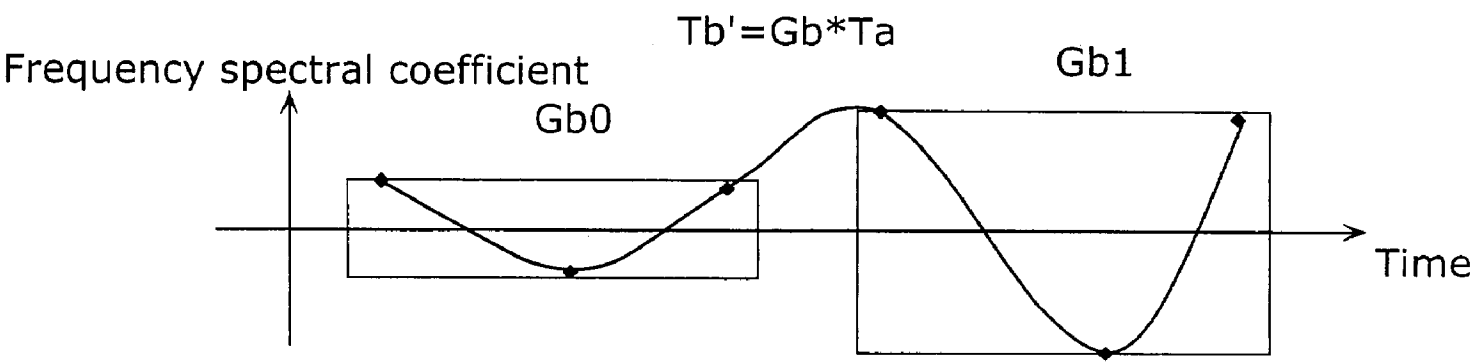
FIG. 19C is a diagram showing an approximate vector Tb' for the case of indicating a vector approximated to the vector Tb by having a gain control over the vector Ta.

The following describes the time composing and encoding unit 1307 with reference to FIG. 18. FIG. 18 is a diagram showing an example of a method for which the frequency spectrum for the target domain is composed in the time domain by using the encoded data stream in the referred band that has already been quantized and encoded. As mentioned above, suppose a signal in the referred band and a signal in the target band have been selected by the reference band deciding unit 1305. In FIG. 18, suppose a band A is the referred band and a band B is the target band. To simplify the explanation, the signal in the band A and the signal in the band B consist of the same number of elements respectively. The time transforming unit 1306 transforms the signals in the frequency domain in the band A and in the band B into signals in the time domain (Tt) in the same way as the time transforming unit 204 of the first embodiment. Here, suppose the signals obtained by transforming the signals in the frequency domain of the band A and the band B are respectively a vector Ta and a vector Tb. Additionally, the vector Ta and the vector Tb can be divided as follows: Ta=(Ta0, Ta1); and Tb=(Tb0, Tb1). Ta0, Ta1, Tb0 and Tb1 are a vector. The number of elements of Ta0 are the same as the number of elements of Tb0, and the number of element of Ta1 is the same as the number of elements of Tb1. However, the number of elements of Ta0 may or may not be the same as the number of elements of Ta1. Also, the parameter Gb=(Gb0, Gb1) is defined here. Gb0 and Gb1 are respectively a scular value. FIG. 19A, FIG. 19B and FIG. 19C are diagrams showing an example of a method that approximates the vector Tb as the signal in the time domain of the band B by using the vector Ta as the signal in the time domain of the band A. FIG. 19A is a diagram showing the vector Ta expressing the signal obtained by transforming the signal in the frequency domain of the band A as the referred band into the one in the time domain. FIG. 19B is a diagram showing the vector Tb expressing the signal obtained by transforming the signal in the frequency domain of the band B as the target band into the one in the time domain. FIG. 19C is a diagram showing an approximate vector Tb' for the case expressing a vector approximated to the vector Tb by performing a gain control over the vector Ta. As shown in FIG. 19A, FIG. 19B and FIG. 19C, a value of the parameter Gb is decided to have the vector Ta multiplied by Gb approximate to the vector Tb.

For example, the approximate vector Tb' is defined as the following formula by using the vector Ta and the parameter Gb.

$$Tb'=Gb*Ta=(Gb\mathbf{0}*Ta\mathbf{0},Gb\mathbf{1}*Ta\mathbf{1}) \quad \text{[Formula 2]}$$

The signal in the time domain for the target band B is composed by the signal in the time domain for the referred band A with the parameter Gb that performs the gain control. Therefore, in the time composing and encoding unit 1307, the data that shows which referred band is used to express a certain target band and the parameter Gb used for the gain control over the referred band are quantized and encoded. To simplify the explanation, the case for dividing the target band and the referred band into two vectors has been described, but they may be divided less or more than two. Also, dividing a band may or may not be even.

In the encoded data stream generating unit 1309, outputs of the quantizing and encoding unit 1304, of the frequency composing and encoding unit 1308, of the time composing and encoding unit 1307, of the frequency characteristic extracting unit 1302 and of the time characteristic extracting unit 1303 are packaged according to a predefined format and encoded data streams are generated along with them. Therefore, the encoded data stream, which is an output signal of the encoding device 1300, contains following data: 1. Data obtained by quantizing and encoding signals in a referred band and in a band that is not a referred nor a target band; 2. Data indicating a relation between the referred band and the target band; 3. Data indicating how the target band is quantized and encoded by using the signal in the referred band; 4. Data indicating in which of the domains, the time domain or the frequency domain, the referred band, the target band and a band categorized as neither of them are quantized and encoded; and so forth. Also, the numbers of samples in the referred band and in the target band and the frequency relevant to each of the bands are contained directly or indirectly in the encoded data stream.

Figure 20:
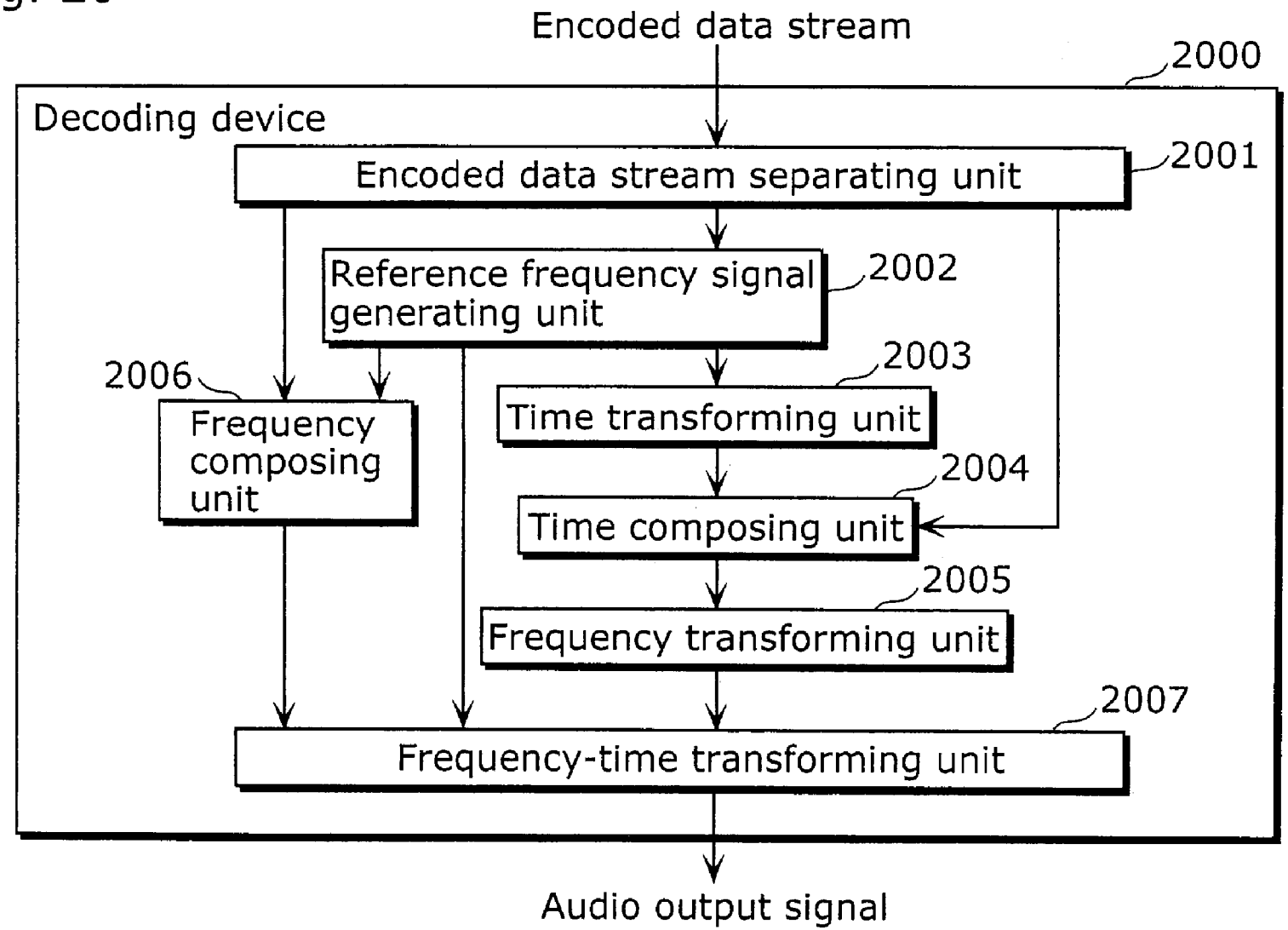
FIG. 20 is a block diagram showing the structure of the decoding device according to the second embodiment.

The following describes a decoding device 2000 according to the second embodiment of the present invention with reference to FIG. 20. FIG. 20 is a block diagram showing the structure of the decoding device 2000 according to the second embodiment. This decoding device 2000 is a decoding device that decodes an encoded data stream generated by the encoding device 1300 and outputs an audio output signal, which includes an encoded data stream separating unit 2001, a reference frequency signal generating unit 2002, a time transforming unit 2003, a time composing unit 2004, a frequency transforming unit 2005, a frequency composing unit 2006, and a frequency-time transforming unit 2007. The frequency-time transforming unit 2007, the time transforming unit 2003 and the frequency transforming unit 2005 in the decoding device 2000 respectively have the same structure as the frequency-time transforming unit 1205, the time transforming unit 1306 and the frequency transforming unit 1203 in the first embodiment. The encoded data stream separating unit 2001 reads a header and the like in the input encoded data stream, separates following data contained in the encoded data stream: 1. Data obtained by quantizing and encoding a signal in a referred band and in a band that is not a referred nor target band; 2. Data indicating a relation between the referred band and the target band; 3. Data indicating how the target band is quantized and encoded by using the signal of the referred band; 4. Data indicating in which of the domains, the time domain or the frequency domain, the referred band and the target band are quantized and encoded, and outputs them to each of the corresponding units. The reference frequency signal generating unit 2002 uses a publicly known decoding method, which is familiar to the people concerned, such as Huffman decoding, and encodes the signal in the frequency domain. It means that signals of Base1 and Base2 in FIG. 14 to FIG. 16 are decoded. Also, it means the signals in the frequency domain of the band A in FIG. 17 and FIG. 18 are decoded.

Actions of the frequency composing unit 2006 are explained with reference to FIG. 17. As shown in FIG. 17, the signal (the frequency spectrum) in the frequency domain expressed as the vector Fa in the band A is obtained by decoding and inverse-quantizing the data in the referred band, which is input to the reference frequency signal generating unit 2002 from the encoded data stream separating unit 2001, in the reference frequency signal generating unit 2002. On the other hand, the signal (the frequency spectrum) in the frequency domain expressed as the vector Fb in the band B is approximated by the approximate vector Fb' composed by using the vector Fa and the parameter Gb according to the formula 1. The parameter Gb for the gain control is obtained by separating from the encoded data stream in the encoded data stream separating unit 2001, and the data indicating that the band A is the referred band of the band B is also obtained by separating from the encoded data stream in the encoded data stream separating unit 2001. In this way, in the frequency composing unit 2006, the signal Fb in the frequency domain of the band B as the referred band is generated by generating the approximate vector Fb'.

Next, actions of the time composing unit 2004 are explained with reference to FIG. 18. In FIG. 18, the signal (the time-frequency signal) in the time domain of the band A indicated as the vector Ta is obtained by executing the time transform (the process of Tf in FIG. 18) through the time transforming unit 2003 to the frequency spectrum indicated as the vector Fa obtained by the reference frequency signal generating unit 2002. Also, the signal (the time-frequency signal) in the time domain indicated as the vector Tb in the band B as a target band is approximated by the approximate vector Tb'. This approximate vector Tb' is composed by the vector Ta and the parameter Gb according to the formula 2. In this way, in the time composing unit 2004, the signal Tb in the time domain of the band B as a target band is generated by generating the approximate vector Tb'. The parameter Gb for the gain control and the data indicating that the band A is the referred band of the band B are obtained from the encoded data stream separating unit 2001. The signal in the time domain indicated as the approximate vector Tb' obtained by the time composing unit 2004 is transformed to a signal in the frequency domain by the frequency transforming unit 2005. In the frequency-time transforming unit 2007, outputs of the reference frequency signal generating unit 2002, of the frequency composing unit 2006 and of the frequency transforming unit 2005 are composed as a signal component on a frequency axis. Moreover, the frequency-time transforming unit 2007 executes an inverse transform of the time-frequency transform to the composed frequency spectrum by the time-frequency transforming unit 1301 of the encoding device 1300, and obtains the audio output signal in the time domain. The frequency-time transform (e.g. inverse MDCT transform) in the frequency-time transforming unit 2007 can be carried out easily by publicly known techniques, which is familiar to the people concerned.

Figure 21:
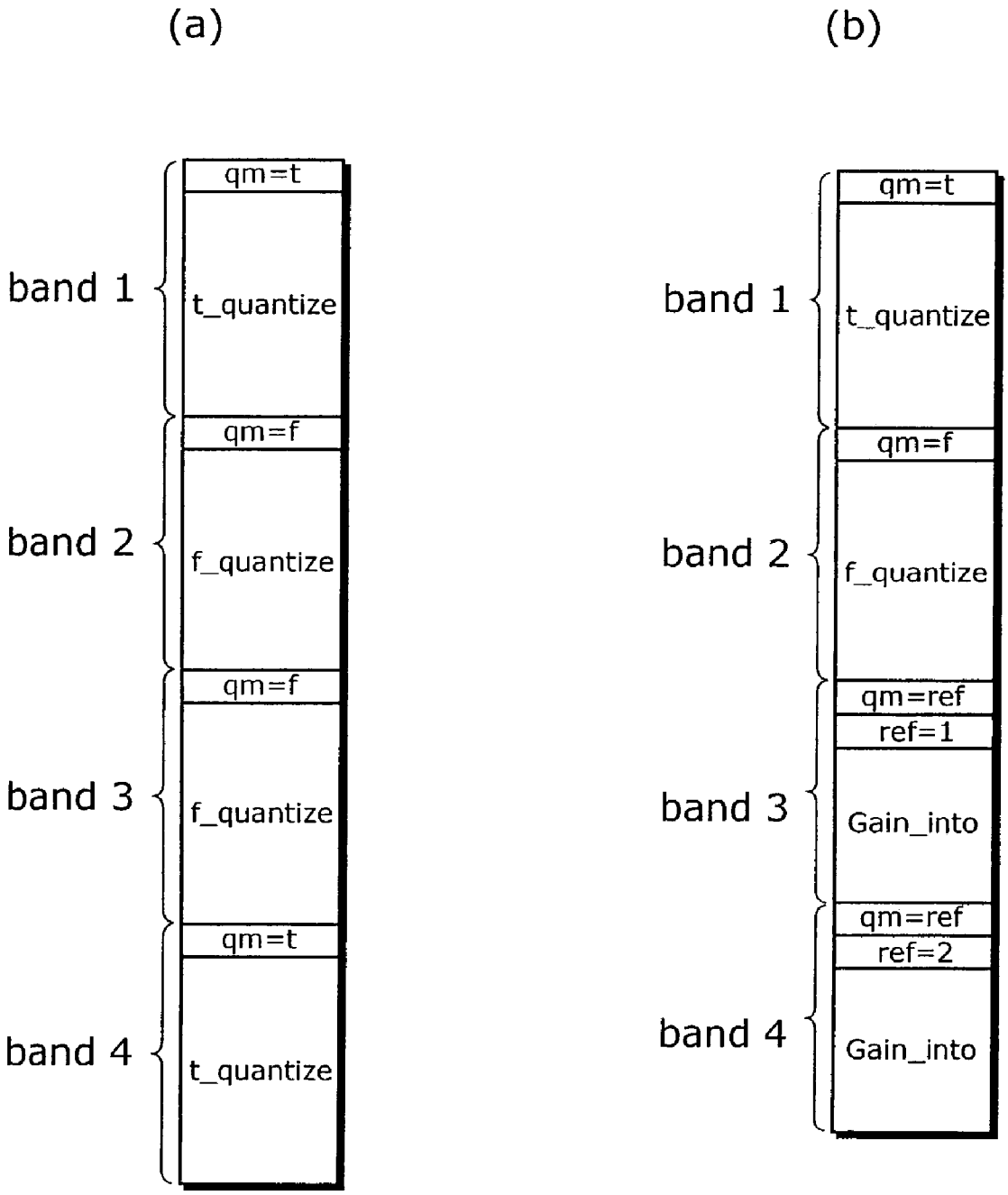
FIG. 21A is a diagram showing an example of the data structure of an encoded data stream generated by the encoded data stream generating unit shown in FIG. 2.
FIG. 21B is a diagram showing an example of the data structure of an encoded data stream generated by the encoded data stream generating unit shown in FIG. 13.

FIG. 21A is a diagram showing an example of the data structure of the encoded data stream generated by the encoded data stream generating unit 205 in FIG. 2. FIG. 21B is a diagram showing an example of the data structure of the encoded data stream generated by the encoded data stream generating unit 1309 in FIG. 13. A bandwidth of each band indicated in FIG. 21A and FIG. 21B may or may not be a fixed bandwidth. In the encoding device 200 of the first embodiment, the frequency spectrum in the band specified by the frequency characteristic extracting unit 202 and the time characteristic extracting unit 203 is quantized and encoded after it is further transformed to a time-frequency signal by the time transforming unit 204. Any bands other than that are quantized and encoded as they are the frequency spectrum. For example, FIG. 21A shows the case that bands specified by the frequency characteristic extracting unit 202 and the time characteristic extracting unit 203 are a band 1 and a band 4. As shown in FIG. 21A and FIG. 21B, a header is described in the front of each band. In FIG. 21A, a flag is described in each header, which shows in which of the domains, the time domain or the frequency domain, the encoded data stream in the band is quantized and encoded. For example, a flag qm=t, which shows encoded data streams t_quantize in the band 1 and the band 4 are quantized and encoded in the time domain, is described respectively in the headers in the band 1 and the band 4. Also, a flag qm=f, which shows an encoded data stream f_quantize in the band 2 and the band 3 is quantized and encoded in the frequency domain, is described in the headers in the band 2 and the band 3. Here, the encoded data streams f_quantize and the encoded data streams t_quantize are an encoded data stream obtained by quantizing and encoding the frequency spectrum in the frequency domain and the time domain respectively.

Also, in the encoding device 1300 of the second embodiment, the frequency spectrum in the bands specified by the frequency characteristic extracting unit 1302 and the time characteristic extracting unit 1303 is encoded by the following four types of the encoding method:

1. Quantize and encode in the frequency domain without reference to other band.
2. Encode in the frequency domain with reference to other band.
3. Quantize and encode in the time domain without reference to other band.
4. Encode in the time domain with reference to other band. Therefore, a flag indicating whether the band refers to another band or not, a band number to show which band is referred to if it refers to another band, a parameter to control the gain of the referred band, and so on are described in the header for each band in the encoded data stream. As shown in FIG. 21B, for example, a flag qm=t showing the encoded data stream t_quantize in the band 1 is quantized and encoded in the time domain is described in the header of the band 1. A flag qm=f showing the encoded data stream f_quantize in the band 2 is quantized and encoded in the frequency domain is described in the header of the band 2. Moreover, the following elements are described in the band 3: a flag qm=ref, which shows an encoded data stream obtained by quantizing and encoding the frequency spectrum in the time domain is not actually contained, and the band 3 is generated with reference to other band; a band number ref=1, which shows the band 1 is the referred band of the band 3; a parameter Gain_info, which controls the gain of the referred band band 1; and so on. Also, in the same way as the band 3, in the band 4, a flag qm=ref, which shows an encoded data stream obtained by quantizing and encoding the frequency spectrum is not actually contained, and the band 4 is generated with reference to other band, a band number ref=2 that shows the band 2 is the referred band for the band 4, a parameter Gain_info to control the gain of the referred band band 2 and the like are described. In the band 3, because the band number ref=1 shows the band 1 quantized and encoded in the frequency domain is referred, it implies that the band 3 is encoded in the frequency domain. In the band 4, because the band number ref=2 indicates the band 2 quantized and encoded in the time domain is referred, it implies that the band 4 is encoded in the time domain.

In FIG. 21A, a flag showing in which of the domains, the time domain or the frequency domain, the encoded data stream in the band is quantized and encoded is described in the header of each band in the encoded data stream. But if which band is quantized and encoded in which domain is predetermined, this flag is not necessary. Also, in FIG. 21B, a flag showing whether the band refers to other band or not, and a band number specifying a referred band for the band are described in the header of each band in each encoded data stream. But if which band refers to which band is predetermined, these data is not necessary.

In the encoding device 1300 and the decoding device 2000 according to the second embodiment of the present invention, if the referred band is selected to a band with lower frequency components and the target band is selected to a band with higher frequency components than the referred band, the referred band is encoded by an existing encoding method, and a code to generate components in the target band is encoded as supplemental data, it is further possible to reproduce sound in a broad band by using the existing encoding method and a small volume of the supplemental data. When the AAC method is used as an existing audio encoding method, it is possible to decode the encoded data stream without making a noise even in a decoding method compatible to the AAC method as long as encoding data to generate components in the target band is included in Fill_element of the AAC method. It is also possible to reproduce sound in a wider band from a relatively small amount of data when the decoding method according to the second embodiment of the present invention is used.

When the encoding device and the decoding device in the present invention structured as above are used, data encoding in the time domain can be carried out in addition to the data encoding in the frequency domain. Therefore, by selecting an encoding method with a higher encoding efficiency, the frequency resolution ability and the time resolution ability can be efficiently improved for the decoded sound that is reproduced. Also, because it is possible to construct the encoded audio data stream with a small volume of data by reusing the signal in the band which has already been encoded, a bit rate for the encoded audio data stream can be kept in a low level. Additionally, if the same bit rate is used, an encoded audio data stream that can obtain an audio signal having a high level of sound quality can be provided. Furthermore, if an analysis-composition type of an orthogonal transform method, which does not require a temporal overlap for dividing the signal, is selected for the time transforming unit 1306, the time transforming unit 2003 and the frequency transforming unit 2005, any additional arithmetic delay in the encoding device and the decoding device can be removed, so that it has a merit in an application where consideration of the delay is required in the encoding and decoding processes.

In the second embodiment above, the reference band deciding unit 1305 decides four types of the encoding method for the band specified by the frequency characteristic extracting unit 1302 and the time characteristic extracting unit 1303, but its actual decision method is not limited to the above.

INDUSTRIAL APPLICABILITY

The encoding device according to the present invention is useful as an audio encoding device which is located in a broadcast station for a satellite broadcasting including BS and CS, as an audio encoding device for a content distribution server which distributes contents via a communication network such as the Internet, and further as a program for encoding audio signals which is executed by a general-purpose computer.

In addition, the decoding device according to the present invention is useful not only as an audio decoding device which is located in an STB at home, but also as a program for decoding audio signals which is executed by a general-purpose computer, a PDA, a cellar phone and the like, and a circuit board, an LSI or the like only for decoding audio signals which is included in an STB or a general-purpose computer, and further as an IC card which is inserted into an STB or a general-purpose computer.

The invention claimed is:

1. An encoding device comprising:

a time characteristic extracting unit for specifying a band of an audio input signal that is to be encoded in the time domain based on a characteristic of the audio input signal, and for outputting data indicating the specified band;

a time-frequency transforming unit for transforming the audio input signal into a frequency spectrum according to a time-frequency transformation, and for outputting a first part of the frequency spectrum and a second part of the frequency spectrum, the second part of the frequency spectrum corresponding to the specified band;

a time transforming unit for transforming the second part of the frequency spectrum into a time-frequency signal according to a frequency-time transformation; and an encoding unit for encoding the first part of the frequency spectrum obtained from the time-frequency transforming unit and the time-frequency signal obtained from the time transforming unit, and for generating the encoded first part of the frequency spectrum and the encoded time-frequency signal as an output signal.

2. The encoding device according to claim 1, wherein the time transforming unit transforms the signal in the specified band to a signal indicating a temporal change of a frequency component according to the frequency-time transformation.

3. The encoding device according to claim 1, wherein the time characteristic extracting unit specifies a frequency band for a part of the audio input signal having a big change in average energy.

4. An encoding device comprising:

a time characteristic extracting unit for specifying one or more bands of an audio input signal that is to be encoded in the time domain based on a characteristic of the input signal, and for outputting data indicating the specified bands;

a time-frequency transforming unit for transforming the audio input signal into a frequency spectrum according to a time-frequency transformation, and for outputting the frequency spectrum;

a reference band deciding unit for deciding a reference band and a target band from among the specified bands, the reference band being utilized to compose the target band, and for outputting a part of the frequency spectrum which corresponds to the specified bands including the reference band and the target band;

a time transforming unit for transforming a part of the frequency spectrum into a time-frequency signal according to a frequency-time transformation;

a time composing and encoding unit for generating a parameter to compose a time-frequency signal for the reference band, and for encoding the parameter and data indicating the target band and the reference band;

an encoding unit for encoding a part of the frequency spectrum obtained from the time-frequency transforming unit, and for outputting an encoded frequency spectrum; and an encoded data stream generating unit for generating an encoded data stream including the encoded frequency spectrum obtained from the encoding unit, encoded data indicating the target band and the reference band obtained from the time composing and encoding unit, and data indicating the specified bands output from the time characteristic extracting unit.

5. The encoding device according to claim 4, wherein the reference band deciding unit generates data that specifies the band used for the approximation and the band approximated in the frequency spectrum.

6. The encoding device according to claim 5, wherein the reference band deciding unit further generates data that indicates a gain of the signal used for the approximation for the signal approximated.

7. The encoding device according to claim 6, wherein the encoding unit encodes, instead of the approximated signal, the data that specifies the band used for the approximation and the data that indicates the gain, which are generated by the reference band deciding unit.

8. An encoding device comprising:

a time characteristic extracting unit for specifying a band of an audio input signal that is to be encoded in the time domain based on a characteristic of the input signal, for outputting data indicating the specified band;

a time-frequency transforming unit operable for transforming the audio input signal into a frequency spectrum according to a time-frequency transformation, and for outputting a first part of the frequency spectrum and a second part of the frequency spectrum, the second part of the frequency spectrum corresponding to the specified band;

a frequency characteristic extracting unit for specifying a third part of the frequency spectrum from the first part of the frequency spectrum obtained by the time-frequency transforming unit that is to be encoded in the time domain based on a characteristic of the first part of the frequency spectrum, for outputting data indicating the specified third part of the frequency spectrum, and for outputting an unspecified part of the first part of the frequency spectrum;

a time transforming unit for transforming a signal of the second part and the third part of the frequency spectrum into a time-frequency signal according to the frequency-time transformation; and an encoding unit for encoding the unspecified part of the first part of the frequency spectrum obtained from the frequency characteristic extracting unit and the time-frequency signal obtained from the time transforming unit, and for generating the encoded unspecified part of the first part of the frequency spectrum and the encoded time-frequency signal as an output signal.

9. The encoding device according to claim 8, wherein the encoding device further includes a reference band deciding unit for specifying two or more bands contained in the frequency spectrum, and for approximating, using a frequency spectrum of a first one of the specified bands, a frequency spectrum of a second one of the specified bands, and wherein the encoding unit encodes the frequency spectrum used for the approximation for the band specified by the reference band deciding unit.

10. The encoding device according to claim 9, wherein the reference band deciding unit generates data that specifies the band used for the approximation and the band approximated in the frequency spectrum.

11. The encoding device according to claim 10, wherein the reference band deciding unit further generates data that indicates a gain of the frequency spectrum used for the approximation for the frequency spectrum approximated.

12. The encoding device according to claim 11, wherein the encoding unit encodes, instead of the approximated frequency spectrum, the data that specifies the band used for the approximation and the data that indicates the gain, which are generated by the reference band deciding unit.

13. The encoding device according to claim 8, wherein the frequency characteristic extracting unit specifies a band having a wide spread of frequency spectral coefficients in the frequency spectrum.

14. A decoding device for decoding encoded data of an encoded data stream obtained by encoding an audio input signal, said decoding device comprising:

a decoding unit for extracting a first part of the encoded data from the encoded data stream and a second part of the encoded data from the encoded data stream, for decoding the first part of the encoded data to generate a first part of a frequency spectrum, and for decoding the second part of the encoded data to generate a time-frequency signal;

a frequency transforming unit for tramsforming the time-frequency signal generated by said decoding unit into a second part of the frequency spectrum; and a frequency-time transforming unit for composing the first part of the frequency spectrum and the second part of the frequency spectrum, and for transforming the composed frequency spectrum into an audio output signal in the time domain.

15. The decoding device according to claim 14, wherein the frequency spectrum obtained by the frequency transforming unit and the frequency spectrum obtained by decoding the encoded data stream extracted from another part of the encoded data stream both indicate a signal on a same time for the same audio input signal.

16. The decoding device according to claim 15, wherein the decoding device further includes a time composing unit for approximating a band, which is indicated by the extracted encoded data stream, by a signal decoded from an encoded data stream in another band, and wherein the frequency transforming unit transforms the approximated signal to a frequency spectrum.

17. The decoding device according to claim 16, wherein the time composing unit specifies a band of the signal, which is used for the approximation of the band indicated by the encoded data stream, according to data contained in the extracted encoded data stream, and executes the approximation using the signal of the specified band.

18. The decoding device according to claim 17, wherein the time composing unit further approximates the band by reading a gain of the signal used for the approximation for the signal approximated from data contained in the extracted encoded data stream, and by adjusting an amplitude of the signal in the specified band using the read gain.

19. The encoding device according to claim 17, wherein the time composing unit specifies a band already transformed to a frequency spectrum, transforms the frequency spectrum of the specified band to a signal according to frequency-time transformation, and approximates a band indicated by the extracted encoded data stream using the signal obtained by the transformation.

20. The encoding device according to claim 16, wherein the decoding device further includes a frequency composing unit for approximating the band, which is indicated by the extracted encoded data stream, by a frequency spectrum decoded from an encoded data stream in another band, and the frequency-time transforming unit further composes the frequency spectrum approximated by the frequency composing unit on the frequency axis, in addition to the frequency spectrum obtained by decoding the encoded data stream extracted from another part of the input encoded data stream, and the frequency spectrum obtained by the frequency transforming unit.

21. The decoding device according to claim 20, wherein the frequency composing unit specifies a band of the frequency spectrum used for the approximation of the band indicated by the encoded data stream, according to data contained in the extracted encoded data stream, and executes the approximation using the frequency spectrum of the specified band.

22. The decoding device according to claim 21, wherein the frequency composing unit further approximates the band by reading a gain of the frequency spectrum used for the approximation for the approximated frequency spectrum from the data contained in the extracted encoded data stream, and by adjusting an amplitude of the frequency spectrum in the specified band using the read gain.

23. An encoding method comprising:

a time characteristic extracting step of specifying a band of an audio input signal that is to be encoded in the time domain based on a characteristic of the audio input original signal, and outputting data indicating the specified band;

a time-frequency transforming step of transforming the audio input signal into a frequency spectrum according to a time-frequency transformation, and outputting a first part of the frequency spectrum and a second part of the frequency spectrum, the second part of the frequency spectrum corresponding to the specified band;

a time transforming step of transforming the second part of the frequency spectrum into a time-frequency signal according to a frequency-time transformation; and an encoding step of encoding the first part of the frequency spectrum obtained by the time-frequency transforming step and the time-frequency signal obtained by the time transforming step, and generating the encoded first part of the frequency spectrum and the encoded time-frequency signal as an output signal.

24. A decoding method for decoding encoded data of an encoded data stream obtained by encoding an audio input signal, said decoding method comprising:

a decoding step of extracting a first part of the encoded data from the encoded data stream and a second part of the encoded data from the encoded data stream, decoding the first part of the encoded data to generate a first part of a frequency spectrum, and decoding the second part of the encoded data to generate a time-frequency signal;

a frequency transforming step of transforming the time-frequency signal generated by said decoding step into a second part of the frequency spectrum; and a frequency-time transforming step of composing the first part of the frequency spectrum and the second part of the frequency spectrum, and transforming the composed frequency spectrum into an audio output signal in the time domain.

25. An encoding method comprising:

a time characteristic extracting step of specifying a band of an audio input signal that is to be encoded in the time domain based on a characteristic of the input signal, and outputting data indicating the specified band;

a time-frequency transforming step of transforming the audio input signal into a frequency spectrum according to a time-frequency transformation, and outputting a first part of the frequency spectrum and a second part of the frequency spectrum, the second part of the frequency spectrum corresponding to the band specified by the time characteristic extracting unit;

a frequency characteristic extracting step of specifying a third part of the frequency spectrum from the first part of the frequency spectrum obtained by the time-frequency transforming unit that is to be encoded in the time domain based on a characteristic of the first part of the frequency spectrum, outputting data indicating the specified third part of the frequency spectrum, and outputting an unspecified part of the first part of the frequency spectrum;

a time transforming step of transforming a signal of the second part and the third part of the frequency spectrum into a time-frequency signal according to the frequency-time transformation; and an encoding step of encoding the unspecified part of the first part of the frequency spectrum obtained from the frequency characteristic extracting unit and the time-frequency signal obtained from the time transforming unit, and generating the encoded unspecified part of the first part of the frequency spectrum and the encoded time-frequency signal as an output signal.

* * * * *

UNITED STATES PATENT AND TRADEMARK OFFICE

CERTIFICATE OF CORRECTION

PATENT NO. : 7,269,550 B2
APPLICATION NO. : 10/409101
DATED : September 11, 2007
INVENTOR(S) : Mineo Tsushima et al.

It is certified that error appears in the above-identified patent and that said Letters Patent is hereby corrected as shown below:

Column 23

Line 14, “, for” should read --, and for--.

Line 16, “unit operable for” should read --unit for--.

Signed and Sealed this

Twentieth Day of May, 2008

JON W. DUDAS
*Director of the United States Patent and Trademark Office*